US009352603B2

(12) United States Patent
Gamo

(10) Patent No.: US 9,352,603 B2
(45) Date of Patent: May 31, 2016

(54) SHEET PROCESSING APPARATUS AND IMAGE FORMING APPARATUS

(75) Inventor: Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/586,179

(22) Filed: Aug. 15, 2012

(65) Prior Publication Data

US 2013/0043636 A1 Feb. 21, 2013

(30) Foreign Application Priority Data

Aug. 19, 2011 (JP) ..... 2011-179663
Jul. 30, 2012 (JP) ..... 2012-168145

(51) Int. Cl.

| | |
|---|---|
| ***B65H 37/04*** | (2006.01) |
| ***B42C 1/12*** | (2006.01) |
| ***B65H 31/32*** | (2006.01) |
| ***B65H 31/34*** | (2006.01) |
| ***B65H 39/10*** | (2006.01) |
| *B42B 4/00* | (2006.01) |

(52) U.S. Cl.

CPC ..... *B42C 1/12* (2013.01); *B65H 31/32* (2013.01); *B65H 31/34* (2013.01); *B65H 39/10* (2013.01); *B42B 4/00* (2013.01); *B65H 2301/4213* (2013.01); *B65H 2301/42194* (2013.01); *B65H 2801/27* (2013.01)

(58) Field of Classification Search

CPC ..... B42C 1/12; B65H 31/32; B65H 31/34; B65H 39/10; B65H 37/04

USPC ..... 270/58.07, 58.08, 58.09, 58.11, 58.16, 270/58.17, 32, 37, 39.08; 493/444, 445

See application file for complete search history.

(56) References Cited

U.S. PATENT DOCUMENTS

| | | | | |
|---|---|---|---|---|
| 7,185,883 | B2 * | 3/2007 | Kato et al. | 270/58.11 |
| 7,192,020 | B2 * | 3/2007 | Hayashi et al. | 270/58.11 |
| 7,354,036 | B2 * | 4/2008 | Hayashi et al. | 270/58.12 |
| 7,540,482 | B2 * | 6/2009 | Fujii et al. | 270/58.1 |
| 7,552,917 | B2 * | 6/2009 | Hayashi et al. | 270/58.12 |
| 7,703,758 | B2 * | 4/2010 | Kamiya et al. | 270/58.09 |
| 8,511,665 | B2 * | 8/2013 | Iwata et al. | 270/58.31 |
| 2007/0045924 | A1 * | 3/2007 | Kamiya et al. | 270/58.1 |
| 2007/0045929 | A1 * | 3/2007 | Fujii et al. | 270/58.14 |
| 2009/0206538 | A1 * | 8/2009 | Fujii et al. | 270/58.18 |
| 2011/0285071 | A1 * | 11/2011 | Miyake et al. | 270/58.07 |
| 2011/0285072 | A1 * | 11/2011 | Yokoya et al. | 270/58.07 |
| 2013/0147106 | A1 * | 6/2013 | Tamura | 270/58.07 |

FOREIGN PATENT DOCUMENTS

JP 10-181988 A 7/1998

* cited by examiner

*Primary Examiner* — Patrick Mackey
(74) *Attorney, Agent, or Firm* — Canon USA, Inc. IP Division

(57) ABSTRACT

While a sheet on an intermediate processing tray is being processed, a plurality of sheets to be processed next are kept on standby by a standby portion arranged between the intermediate processing tray and a conveyance roller and a separation roller. When conveying the plurality of sheets that have been kept on standby in an overlapped state while successively shifting the sheets from each other in the sheet conveyance direction, the shift amount is successively reduced.

29 Claims, 22 Drawing Sheets

SHEET PROCESSING APPARATUS AND IMAGE FORMING APPARATUS

BACKGROUND OF THE INVENTION

1. Field of the Invention

The present invention relates to a sheet processing apparatus and, in particular, to a sheet processing apparatus in which, while a sheet is being processed, the next sheet is kept on standby, and an image forming apparatus.

2. Description of the Related Art

Conventionally, some image forming apparatuses such as copying machines, laser beam printers, facsimile apparatuses, and multifunction peripherals including these, are equipped with a sheet processing apparatus configured to perform processing such as stitching processing or sort processing on sheets with images formed thereon.

As such a sheet processing apparatus, a sheet processing apparatus is widely in use in which an intermediate processing tray is provided and in which a plurality of sheets is stacked on this intermediate processing tray to form a sheet bundle, on which stitching processing is performed.

And, in such a sheet processing apparatus, when performing stitching processing on sheets, a certain processing time is required. This processing time depends to some degree on the image forming speed of the image forming apparatus. However, it is rather difficult to complete stitching processing at a sheet discharge interval. As a result, it is common for the processing time to exceed the sheet discharge interval. Thus, when performing stitching processing, it is necessary to interrupt the image formation, which, however, results in a reduction in productivity.

Therefore, in a conventional sheet processing apparatus, while, for example, stitching processing is being performed on a preceding sheet bundle on the intermediate processing tray, there is performed a standby processing on several foremost sheets of a subsequent sheet bundle, keeping these foremost sheets on standby (See Japanese Patent Application Laid-Open No. 10-181988).

In such a sheet processing apparatus, after the discharge of the preceding sheet bundle, the several sheets that have been kept on standby are conveyed to the intermediate processing tray in an overlapped state. This makes it possible to perform sheet processing without having to interrupt the image formation.

FIG. 18 illustrates such a conventional sheet processing apparatus. While stitching processing is being performed on the preceding sheet bundle on an intermediate processing tray 14, a preceding sheet S1 is wrapped around a buffer roller 5, and the preceding sheet S1 is temporarily kept on standby. At the timing a subsequent sheet S2 passes through the buffer roller 5, the preceding sheet S1, which has been temporarily kept on standby, is returned to a conveyance path, and the preceding sheet S1 and the subsequent sheet S2 are overlapped. Hereinbelow, a predetermined number of sheets are overlapped in the same fashion.

Thereafter, when the stitching processing on the preceding sheet bundle has completed and the preceding sheet bundle has been discharged, the sheet bundle, i.e., the overlapped sheets, is delivered to bundle discharge rollers 18*a* and 18*b* by a discharge roller 7. Then, when the trailing edge of the sheet bundle has passed the discharge roller 7, the bundle discharge rollers 18*a* and 18*b* make reverse rotation, and the bundle discharge rollers 18*a* and 18*b* are spaced away from each other, whereby the sheet bundle is discharged so as to be abutted against a rear end portion stopper 3 of the intermediate processing tray 14.

In this way, conventionally, the first several sheets of each sheet bundle from the subsequent copy are kept on standby at a temporary standby portion, i.e., the buffer roller 5, thus securing time until the stitching processing is completed on the last sheet bundle of the preceding first copy. With this arrangement, even in an image forming apparatus with high image forming speed and small sheet discharge interval, it is possible to perform stitching processing on the sheets without having to stop the output from the image forming apparatus even while the stitching processing is performed.

In such a conventional sheet processing apparatus, when overlapping sheets, the lower sheet is shifted in the direction of the rear end portion stopper 3. Thus, when discharged, due to the movement in the discharge direction caused by the inertia acting to continue the movement, the sheets of the sheet bundle successively are abutted against the rear end portion stopper 3 starting with the lower sheet.

The image forming speed of image forming apparatuses is increasing from year to year, and, to secure time for stitching processing in the standby processing, it is necessary to increase the number of sheets overlapped in the standby processing. However, when the number of overlapped sheets thus increases, due to resistance such as friction when a sheet moves on another sheet, those of the sheets overlapped at the upper position collide with the rear stopper at lower speed.

In view of this, as illustrated in FIG. 19A, when an upper most sheet S of the overlapped sheets is discharged at a high speed Vf to cause the sheet S to collide against the rear end portion stopper, the lower sheets collide against the rear end portion stopper with momentum, resulting in rebounding of the sheets, which is problematic. On the other hand, when, as illustrated in FIG. 19B, the sheet S is discharged at a low speed V1 so that the lowermost sheet may not rebound, the uppermost sheet S may stop halfway without reaching the rear end portion stopper.

When such phenomena occur, stitching is performed with the end portions of the sheets not being aligned. As a result, the sheet bundle is stitched with the sheet ends not aligned, resulting in a product of poor quality or a product in which a part of the sheets constituting the sheet bundle is not stitched.

SUMMARY OF THE INVENTION

The present invention is directed to a sheet processing apparatus capable of performing sheet standby processing without causing any defective alignment, and an image forming apparatus equipped therewith.

According to an aspect of the present invention, a sheet processing apparatus configured to process sheets includes a sheet stacking portion on which sheets to be processed are stacked, a sheet conveyance portion configured to convey a sheet, a sheet standby portion, arranged between the sheet stacking portion and the sheet conveyance portion, configured to overlap a plurality of sheets to be next processed one on top of the other and keep the plurality of sheets on standby while the sheets on the sheet stacking portion are being processed, an end portion stopper against which one end in a sheet conveyance direction of each of the plurality of sheets conveyed from the sheet standby portion to the sheet stacking portion is abutted, and a control unit configured to control the sheet standby portion so that the sheets conveyed to the sheet standby portion are overlapped while successively shifting the sheets in the sheet conveyance direction with a shift amount between the one ends to be abutted against the end portion stopper of the successive sheets are reduced in order of sheet conveyance to the standby portion. An aspect of the present invention may be a sheet processing method. The sheet processing method may comprise stacking a plurality of sheets such that end portions of the plurality of sheets are shifted from one another. The amount that a sheet in the stack of sheets is shifted from a sheet below it is between a first shift value and a second shift value. The sheet processing method may also comprise conveying the plurality of sheets with a collision velocity towards an end portion stopper. The collision velocity is between a first velocity and a second velocity. The first shift value, the second shift value, first velocity, and the second velocity are chosen to prevent rebound of the plurality of sheets when the plurality of sheets hit the end portion stopper, and to ensure that all sheets in the plurality of sheets reach the end portion stopper.

According to aspects of the present invention, a plurality of sheets to be processed next are kept on standby at the sheet standby portion, and the plurality of sheets on standby are conveyed in an overlapped state, with the shift amount being successively reduced, whereby it is possible to perform sheet standby processing without causing any defective alignment.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
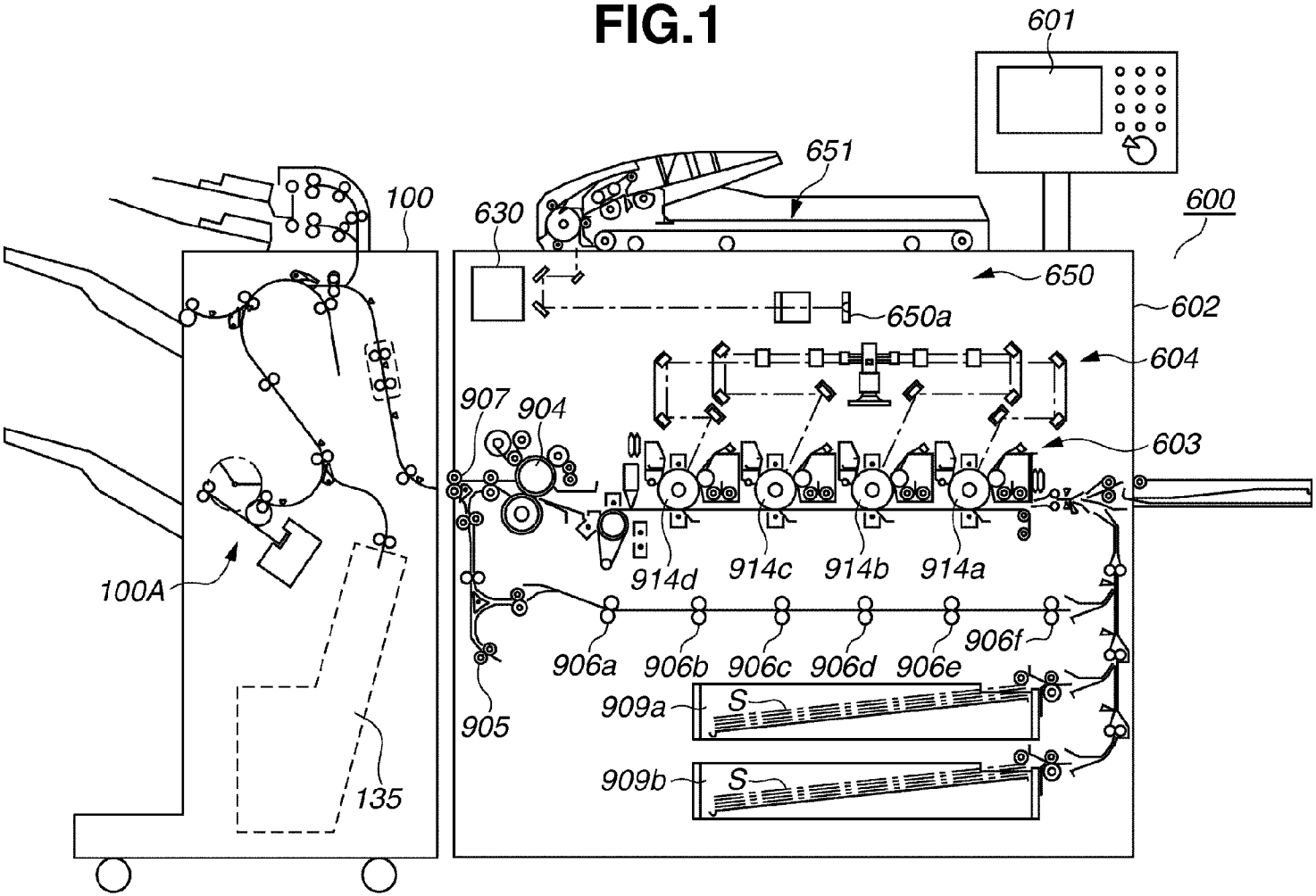
FIG. 1 is a diagram illustrating a configuration of a monochrome/color copying machine, which is an example of an image forming apparatus equipped with a sheet processing apparatus according to a first exemplary embodiment of the present invention.

FIG. 1 is a diagram illustrating a monochrome/color copying machine, which is an example of an image forming apparatus equipped with the sheet processing apparatus according to a first exemplary embodiment of the present invention. In FIG. 1, the monochrome/color copying machine 600 includes a monochrome/color copying machine main body 602 (hereinafter, referred to as the copying machine main body), a document reading portion (image reader) 650 provided on the upper portion of the copying machine main body 602, and a document conveyance apparatus 651 for automatically reading a plurality of documents.

The copying machine main body 602 is equipped with sheet feeding cassettes 909*a* and 909*b* in which normal sheets S for image formation are stacked, an image forming portion 603 for forming a toner image on a sheet by an electrophotographic process, and a fixing unit 904 for fixing the toner image formed on the sheet, etc.

Further, on the upper surface of the copying machine main body 602, there is provided an operation portion 601 allowing a user to perform various input/setting operations on the copying machine main body 602. Further, connected to a side of the copying machine main body 602 is a finisher 100 serving as a sheet processing apparatus. A central processing unit (CPU) circuit unit 630 controls the copying machine main body 602 and the finisher 100.

In the monochrome/color copying machine 600, when forming an image of a document (not illustrated) on a sheet, the image of the document conveyed by a document conveyance apparatus 651 is read by an image sensor 650*a* provided in the document reading portion 650.

After this, the digital data thus read is input to an exposure portion 604, and the exposure portion 604 irradiates photosensitive drums 914 (914*a* through 914*d*), provided in the image forming portion 603, with light corresponding to the digital data. When thus irradiated, electrostatic latent images are formed on the surfaces of the photosensitive drums. By developing these electrostatic latent images, toner images of the colors of yellow, magenta, cyan, and black are formed on the surfaces of the photosensitive drums, respectively.

Next, the toner images in the four colors are transferred to a sheet fed from the sheet feeding cassettes 909*a* or 909*b*. After this, the toner images transferred onto the sheet is permanently fixed to the sheet by the fixing unit 904. In the mode in which the image is formed on one surface of the sheet, the sheet is, after the fixing of the toner images thereto, discharged as it is to the finisher 100 connected to the side portion of the copying machine main body 602 from a discharge roller pair 907.

In the mode in which images are formed on both sides of the sheet, the sheet is delivered to a reverse roller 905 from the fixing unit 904. After this, the reverse roller 905 is caused to make reverse rotation with a predetermined timing, to convey the sheet in the direction of two-side conveyance rollers 906*a* through 906*f*. After this, the sheet is conveyed to the image forming portion 603, and toner images of the four colors of yellow, magenta, cyan, and black are transferred to the back surface of the sheet.

After the transfer of the toner images of the four colors to the back surface of the sheet, the sheet is conveyed to the fixing unit 904 again, where the toner images are fixed thereto. After this, the sheet is discharged by the discharge roller pair 907 to be conveyed to the finisher 100.

The finisher 100 successively takes in the sheets discharged from the copying machine main body 602, and aligns the plurality of sheets thus taken in into one bundle before performing punching processing near the trailing ends of the sheets taken in to perforate the bundle. Further, the finisher 100 performs a staple processing (stitching processing) in which the rear end side of the sheet bundle is stapled, bookbinding processing, etc.

The finisher 100 is equipped with a staple unit 100A configured to staple sheets, and a saddle portion 135 configured to perform bookbinding on a two-folded sheet bundle. Further, the finisher 100 is equipped with a sheet standby portion 100C described below.

Figure 2:
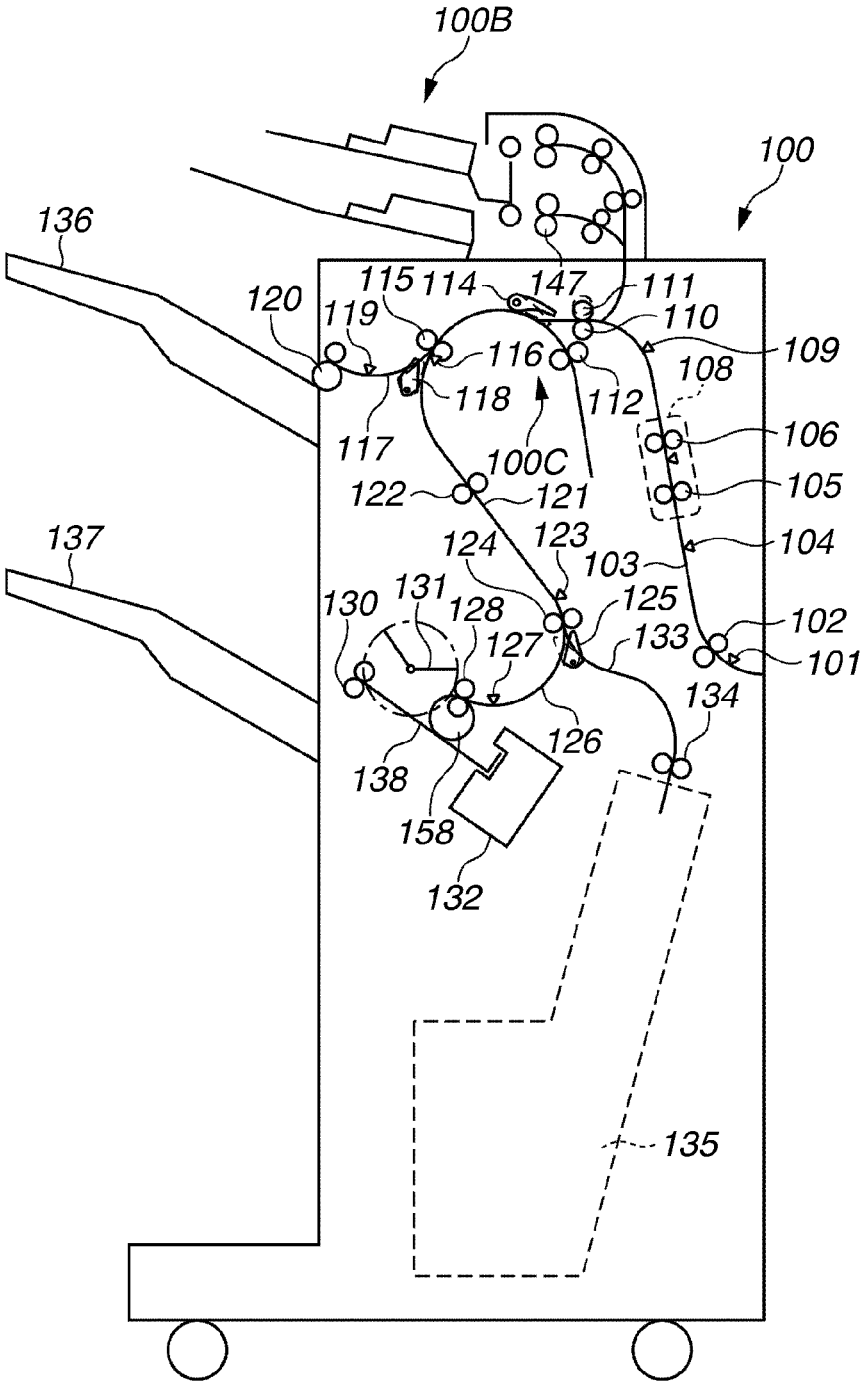
FIG. 2 is a diagram illustrating a configuration of a finisher, which is an example of the sheet processing apparatus.

As illustrated in FIG. 2, the finisher 100 is equipped with an inlet roller pair 102 for taking a sheet into the inside of the apparatus. The sheet discharged from the copying machine main body 602 is delivered to the inlet roller pair 102. At this time, the sheet delivery timing is simultaneously detected by an inlet sensor 101.

After this, the sheet conveyed by the inlet roller pair 102 passes through a conveyance path 103. During that time, the end portion position of the sheet is detected by a lateral registration sensor 104 to detect to what degree a deviation in the width direction has been generated with respect to the center position of the finisher 100.

After the deviation in the width direction (hereinafter referred to as lateral registration error) has been thus detected, a shift unit 108 is moved in the front direction or the back direction by a predetermined amount while the sheet is being conveyed by shift roller pairs 105 and 106, whereby the shift operation is performed on the sheet. Here, the "front" side refers to the front surface side where the user is standing facing the operation portion 601 illustrated in FIG. 1, and the "back" side refers to the back side of the apparatus.

Next, the sheet is conveyed by a conveyance roller 110 and a separation roller 111 before reaching a first buffer roller pair 115. After this, when discharging the sheet onto an upper tray 136, an upper path switching member 118 is placed in the state indicated by the broken line in FIG. 2 by a driving unit such as a solenoid (not illustrated). As a result, the sheet is guided to an upper path conveyance path 117, and is discharged onto the upper tray 136 by an upper discharge roller 120.

When the sheet is not discharged onto the upper tray 136, the sheet conveyed by the first buffer roller pair 115 is guided by a bundle conveyance path 121 by the upper path switching member 118 in the state indicated by the solid line. After this, the sheet is caused to successively pass through the conveyance path by a conveyance roller 122 and a bundle conveyance roller pair 124. When performing buffering on the sheet as illustrated below, a first buffer roller pair 115 and a second buffer roller pair 112 are driven based on the detection by first and second buffer sensors 109 and 116.

Next, when discharging the conveyed sheet onto a lower stacking tray 137, the sheet is conveyed to a lower path 126 by a saddle path switching member 125 in a state indicated by a solid line. After this, the sheet is successively conveyed by a lower discharge roller pair 128 serving as a sheet conveyance portion onto an intermediate processing tray 138 serving as a sheet stacking portion on which the sheet to be processed is stacked.

Figure 3:
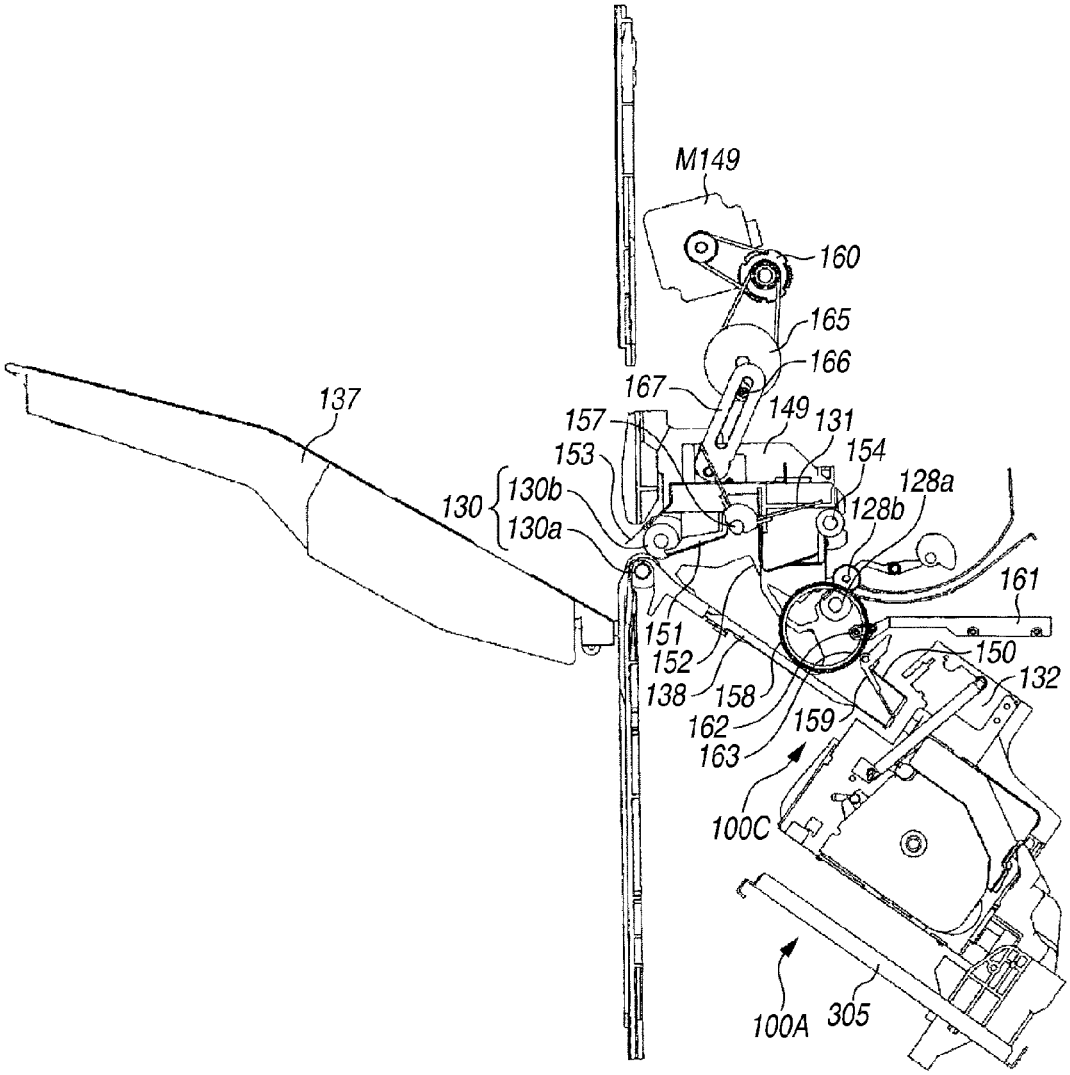
FIG. 3 is a diagram illustrating a configuration of a staple unit provided on the finisher.

Here, as illustrated in FIG. 3, the intermediate processing tray 138 is arranged in an inclined manner so that the downstream side (the left-hand side in FIG. 3) thereof is higher with respect to the sheet bundle discharge direction, and the upstream side (the right-hand side in FIG. 3) is lower, and a rear end portion stopper 150 is arranged at the lower end portion that is the upstream side of the intermediate processing tray 138.

At the downstream side end portion of the intermediate processing tray 138, there is arranged a bundle discharge roller pair 130 (130*a* and 103*b*), and the upper discharge roller 130*b* is arranged at a lower surface front end portion of a swing guide 149.

The upper discharge roller 130*b* is configured to move toward and away from the lower discharge roller 130*a* as the swing guide 149 makes an opening/closing movement. The bundle discharge roller pair 130*a* and 130*b* is configured to make normal and reverse rotation by a bundle discharge motor (not illustrated).

Further, the swing guide 149 is supported by a support shaft 154, and is rotatable around the support shaft 154. The swing guide 149 is vertically movable by a drive motor M149. A stapler 132 serving as a stitching unit is fixed to a slide support 305, and is configured to move along the trailing edge of the sheet stacked on the intermediate processing tray 138.

A plurality of drawing-in paddles 131 are arranged along a drive shaft 157 arranged above the intermediate processing tray 138, and are rotated at an appropriate timing around the drive shaft 157 by a drive motor (not illustrated). A belt roller 158 is stretched around the outer periphery of the lower discharge roller 128*a*, and is configured to be driven to rotate by the rotation of the lower discharge roller 128*a*.

The lower portion of the belt roller 158 can be located at a position where it is in contact with the uppermost sheet stacked on the intermediate processing tray 138 and at a position where it does not interfere with the sheet discharged onto the intermediate processing tray 138 by a traction member 161, 162.

Then, the sheets conveyed to the intermediate processing tray 138 are aligned while being successively stacked by the returning members such as the paddles 131 and the belt roller 158, and a predetermined number of sheets undergo alignment processing on the intermediate processing tray for performing processing on a sheet bundle aligned and stacked.

Next, the sheet bundle which has thus undergone alignment processing on the intermediate processing tray is subjected to stitching processing by the stapler 132 constituting the stitching unit as needed before being discharged onto the lower stacking tray 137 by the bundle discharge roller pair 130. This stapler 132 is movable in a width direction (herein after referred to as the backward direction) which is orthogonal to the sheet conveyance direction, and can perform stitching processing at a plurality of positions of the trailing end portion of the sheet bundle on the intermediate processing tray (on the sheet stacking portion).

On the other hand, when performing saddle (saddle stitching) processing on sheets, a saddle path switching member 125 is switched by a drive unit such as a solenoid (not illustrated). As a result, the sheets are conveyed to a saddle path 133, and are guided to a saddle portion 135 by a saddle inlet roller pair 134 to undergo saddle processing (saddle stitching).

In FIG. 2, an inserter 100B is provided on top of the finisher 100. The inserter 100B is used to insert another sheet (insert sheet) between the foremost page and last page of a sheet bundle or between sheets on which images have been formed by the copying machine main body 602.

Figure 4:
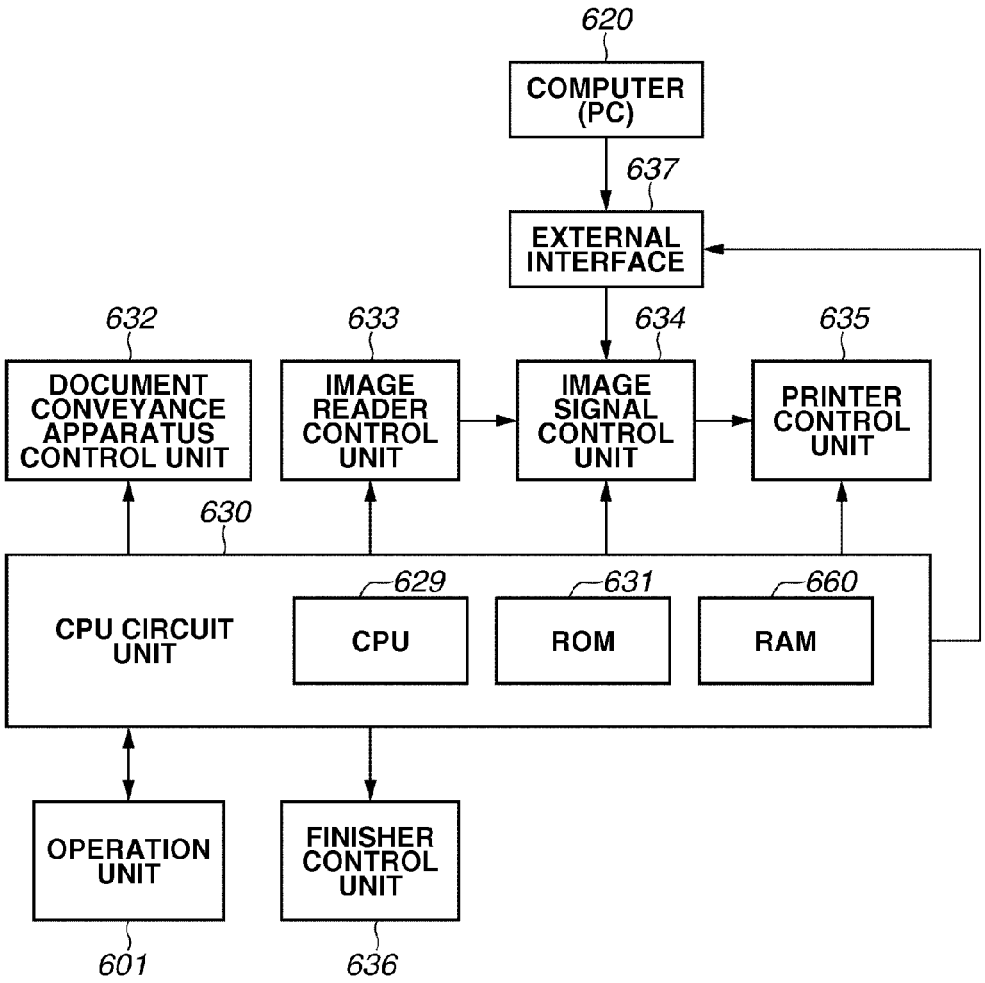
FIG. 4 is a control block diagram of the monochrome/color copying machine.

FIG. 4 is a control block diagram illustrating the monochrome/color copying machine 600, and a CPU circuit unit 630 has a CPU 629, a read-only memory (ROM) 631 storing control programs, etc., and a random-access memory (RAM) 660 used as an area for temporarily holding control data and as an operation area for calculation involved in the control.

In FIG. 4, an external interface 637 is an external interface between the monochrome/color copying machine 600 and an external personal computer (PC) 620. When receiving print data from the external PC 620, the external interface 637 rasterizes the data in a bit map image, and outputs it to an image signal control unit 634 as image data.

Then, the image signal control unit 634 outputs the data to a printer control unit 635, and the printer control unit 635 outputs the data from the image signal control unit 634 to an exposure control unit (not illustrated). From the image reader control unit 633 to the image signal control unit 634, an image of a document read by an image sensor 650*a* (see FIG. 1) of the document reading portion 650 is output, and the image signal control unit 634 outputs the image output to the printer control unit 635.

Further, the operation portion 601 has a plurality of keys for setting various functions relating to image formation, and a display unit for displaying the setting condition. A key signal corresponding to the operation of each key by the user is output to the CPU circuit unit 630, and corresponding information is displayed on the display unit based on the signal from the CPU circuit unit 630.

In accordance with the control program stored in the ROM 631 and the setting of the operation portion 601, the CPU circuit unit 630 controls the image signal control unit 634, and controls the document conveyance apparatus 651 (see FIG. 1) via a document feeding apparatus control unit 632.

Further, the document reading portion 650 (see FIG. 1) is controlled via the image reader control unit 633, the image forming portion 603 (See FIG. 1) is controlled via the printer control unit 635, and the finisher 100 is controlled via the finisher control unit 636.

In the present exemplary embodiment, the finisher control unit 636 as a control unit is mounted on the finisher 100, and performs exchange of information with the CPU circuit unit 630, thereby performing drive control of the finisher 100. It is also possible to arrange the finisher control unit 636 on the copying machine main body side integrally with the CPU circuit unit 630, and to control the finisher 100 directly from the copying machine main body side.

Figure 5:
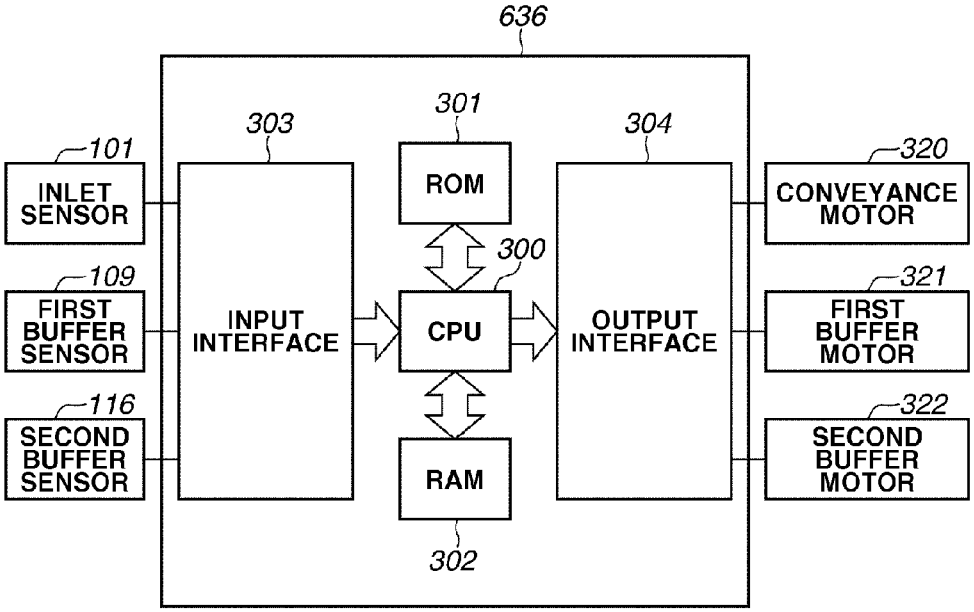
FIG. 5 is a control block diagram of the finisher.

FIG. 5 is a control block diagram illustrating the finisher 100 according to the present exemplary embodiment. The finisher control unit 636 that controls the finisher 100 includes a CPU (microcomputer) 300, a RAM 302, a ROM 301, an input interface 303, an output interface 304

Here, a punching processing program, a stapling processing program, and the like are previously stored in the ROM 301. The CPU 300 executes each program, and performs input data processing while exchanging data with the RAM 302 as needed, whereby a predetermined control signal is generated.

Connected to the input interface 303 are an inlet sensor 101, a first buffer sensor 109, and a second buffer sensor 116. Connected to the output interface 304 is a conveyance motor 320 for driving a conveyance roller 110.

Further, connected to the output interface 304 are a first buffer motor 321 capable of normal and reverse rotation and configured to drive a first buffer roller pair 115, and a second buffer motor 322 capable of normal and reverse rotation and configured to drive a second buffer roller pair 112. The finisher control unit 636 outputs a drive signal to each motor via the output interface 304 based on a signal from each sensor input via the input interface 303.

In the present exemplary embodiment, when, for example, performing stitching processing, while a sheet bundle on the intermediate processing tray is being processed, the first plurality of sheets of the sheet bundle to be next processed are overlapped one on top of another and kept on standby. Then, when processing the next sheets after the completion of the processing of the sheet bundle on the intermediate processing tray, the first plurality of sheets that have been kept on standby are conveyed to the intermediate processing tray 138 in the overlapped state.

Next, the stitching processing performed on the sheet bundle overlapped by the buffering processing will be described with reference to FIGS. 6 and 7.

Figure 6A:
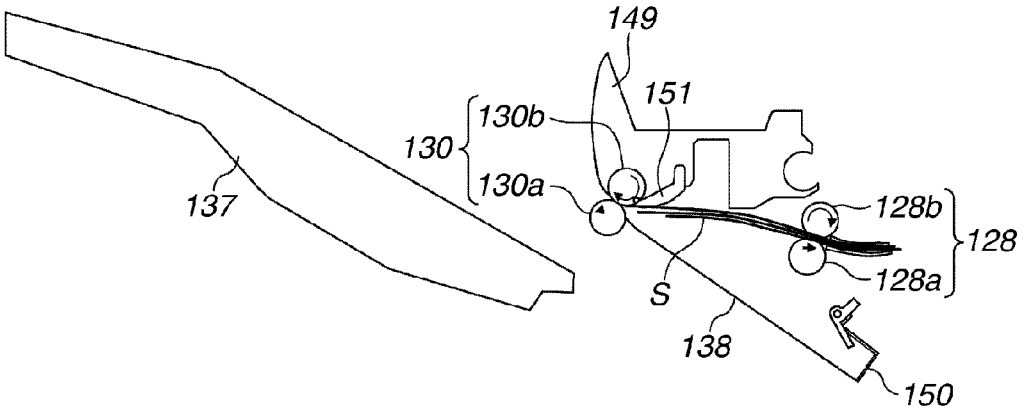
FIGS. 6A, 6B, and 6C are first diagrams illustrating stitching processing by the finisher.

First, as illustrated in FIG. 6A, when buffer sheets S are conveyed from the lower discharge roller pair 128, the buffer sheets S, which are a plurality of (n) overlapped sheets, are guided to a nip portion of a bundle discharge roller pair 130 along a guide 151.

At this time, the swing guide 149 is closed, and the rollers of the bundle discharge roller pair 130 are in contact with each other. The bundle discharge roller pair 130 is rotating so as to discharge the buffer sheets S onto the stacking tray 137.

Figure 6B:
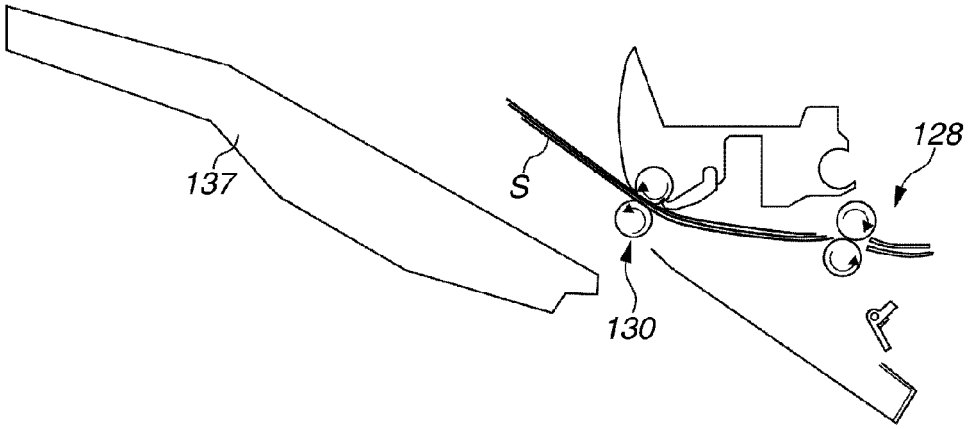

As a result, as illustrated in FIG. 6B, the buffer sheets S delivered to the bundle discharge roller pair 130 are conveyed as they are so as to be discharged onto the stacking tray 137 until their trailing edges leave the lower discharge roller pair 128.

Figure 6C:
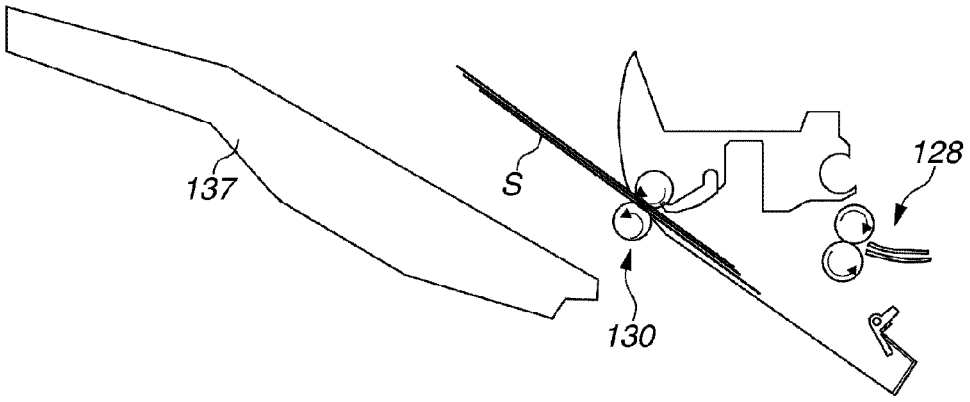
Figure 7A:
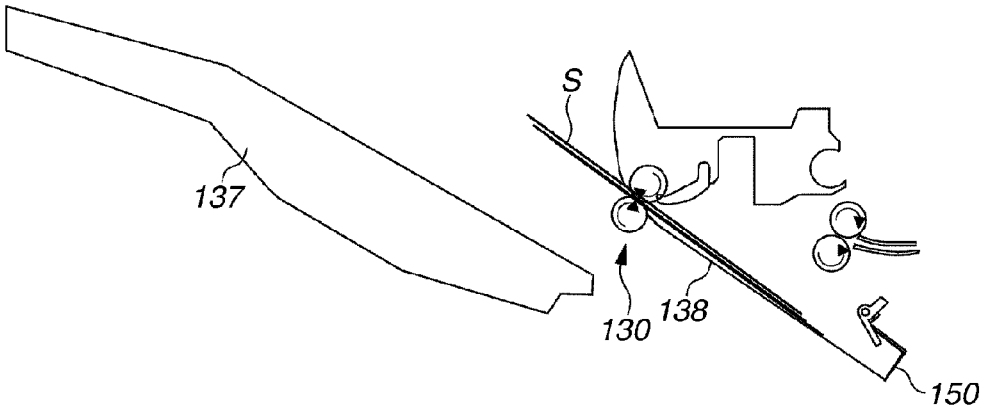
FIGS. 7A, 7B, and 7C are second diagrams illustrating the stitching processing by the finisher.

After this, as illustrated in FIG. 6C, when the trailing edges of the buffer sheets S have left the lower discharge roller pair 128 and when the sheets are stacked on the intermediate processing tray 138, the bundle discharge roller pair 130 makes reverse rotation as illustrated in FIG. 7A. As a result, the buffer sheets S are conveyed so as to be abutted against the rear end portion stopper 150 provided on the downstream side in the discharge direction of the intermediate processing tray 138.

Figure 7B:
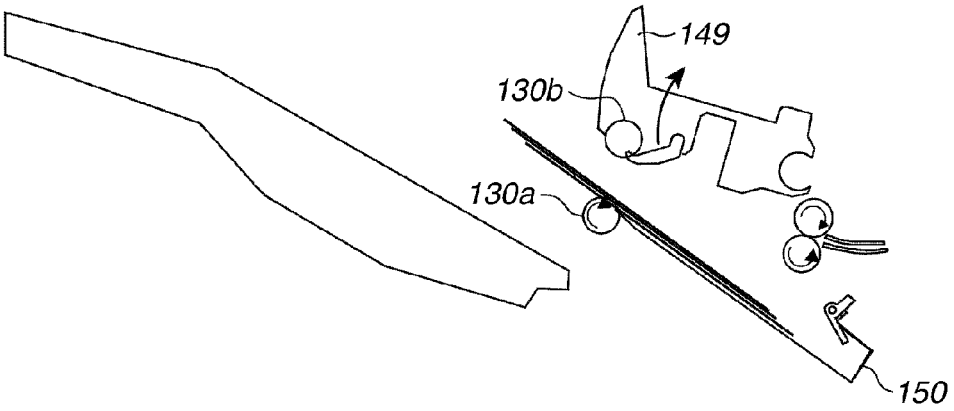
Figure 7C:
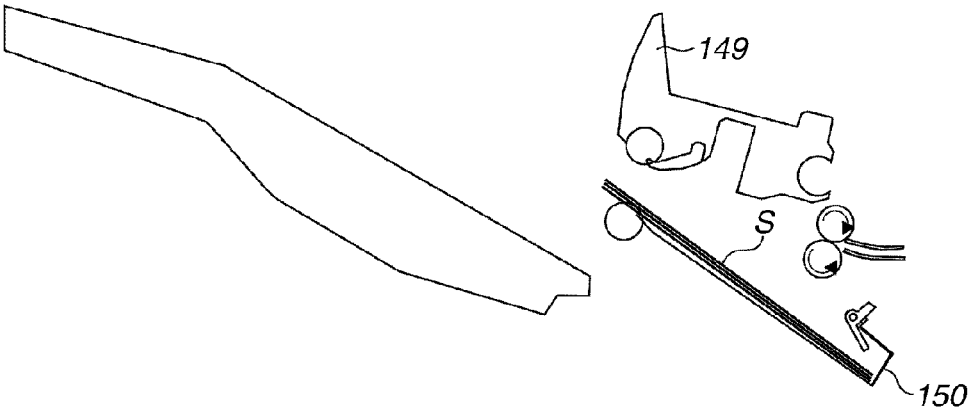

Next, as illustrated in FIG. 7B, before the buffer sheets S are abutted against the rear end portion stopper 150, the swing guide 149 is opened, and the bundle discharge roller pair 130*a* and 130*b* are separated from each other, and the buffer sheets S are discharged toward the rear end portion stopper 150. After this, as illustrated in FIG. 7C, the buffer sheets S are abutted against the rear end portion stopper 150, and the downstream ends thereof in the sheet discharge direction are aligned.

Figure 8A:
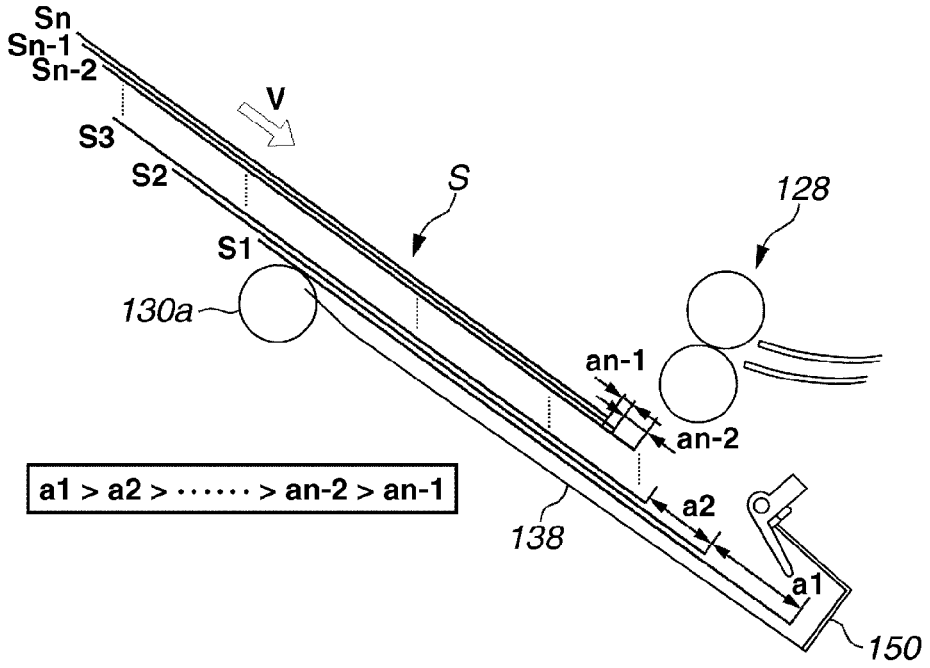
FIGS. 8A and 8B are first diagrams illustrating movement of sheets when stacked on an intermediate processing tray while overlapped at the time of stitching processing by the finisher.

Here, as illustrated in FIG. 8A, in the present exemplary embodiment, the buffer sheets S are overlapped in such a manner that the lower the sheet is, the more the sheet is shifted toward the rear end portion stopper 150. In other words, of the sheets S1 through Sn, which are vertically overlapped, the lower the sheet, i.e., the smaller the sheet number is, the more the sheet is shifted toward the rear end portion stopper 150.

Further, the shift amounts a1 through an-1 are determined in such a manner that the shift amount between adjacent sheets in the conveyance direction is successively reduced starting from the lowermost sheet, i.e., a1>a2> . . . >an-2>an-1.

Figure 8B:
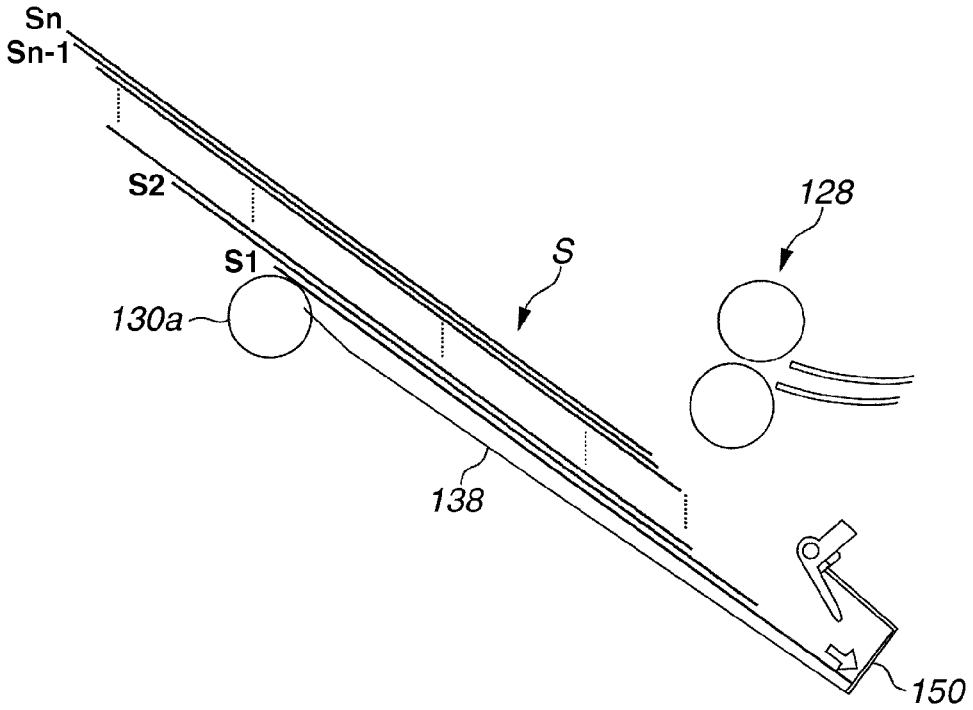
Figure 9A:
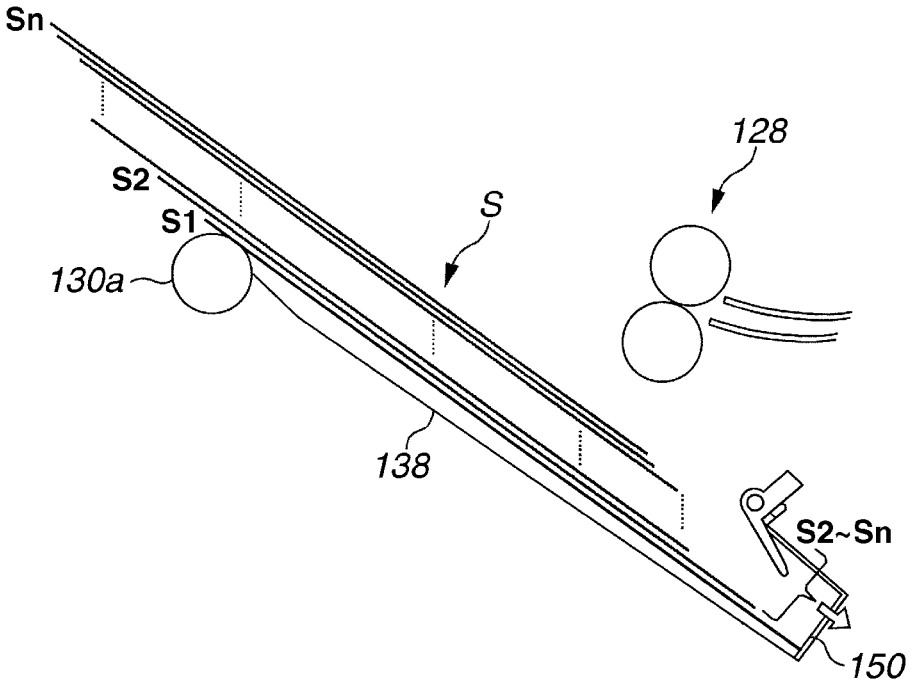
FIGS. 9A and 9B are second diagrams illustrating the movement of the sheets when stacked on the intermediate processing tray in an overlapped state at the time of stitching processing by the finisher.

When, in this state, the buffer sheets S are discharged at a discharge speed v, the lowermost sheet S1 is abutted first against the rear end portion stopper 150 at a speed v1 as illustrated in FIG. 8B. After the sheet S1 has thus been abutted against the rear end portion stopper 150, the movement of the sheet S1 is regulated by the rear end portion stopper 150. However, as illustrated in FIG. 9A, the sheets S2 through Sn continue to move caused by inertia.

Figure 9B:
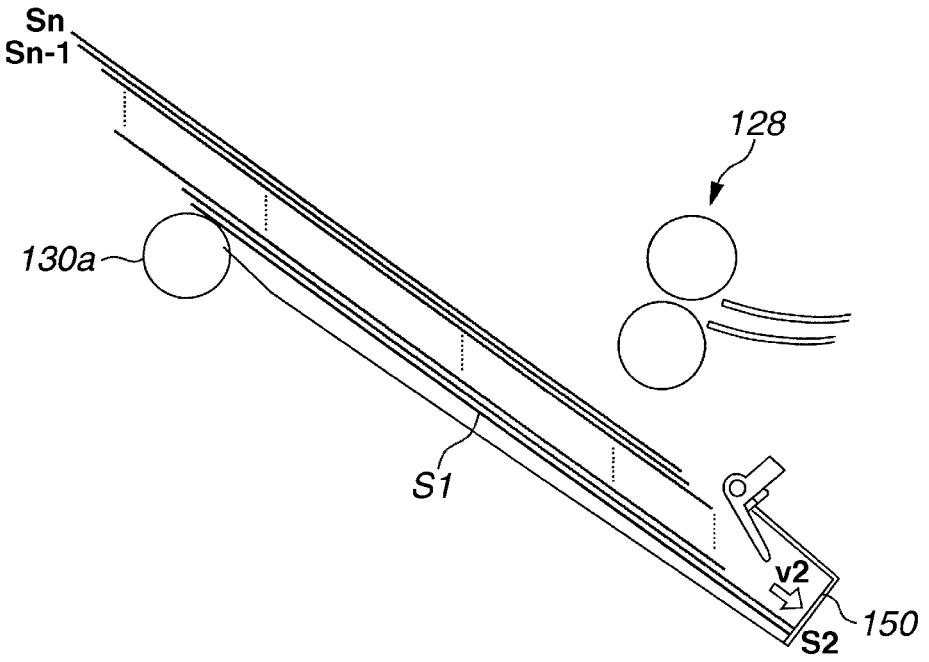

As a result, as illustrated in FIG. 9B, after this, the sheet S2 is abutted against the rear end portion stopper 150 at a speed v2. Such movement is repeated, and the buffer sheets S successively are abutted against the rear end portion stopper 150 starting with the lowermost sheet. In this way, the buffer sheets S successively are abutted against the rear end portion stopper 150 starting with the lowermost one, and the downstream side ends of the sheets in the discharge direction are aligned.

Here, the speed v2 at which the sheet S2 is abutted against the rear end portion stopper 150 is lower than the speed v1 at which the sheet S1 is abutted against the rear end portion stopper 150 due to the frictional resistance offered to the sheets S2 through Sn when they move over the sheet S1 owing to inertia.

Thereafter, similar movement is repeated, so that the upper the sheet of the overlapped sheets is, the lower the speed at which it is abutted against the rear end portion stopper 150 is. Therefore, depending on the buffer sheet discharge speed v, there occurs a non-return phenomenon in which an upper sheet fails to reach the rear end portion stopper 150.

Thus, to prevent such a non-return phenomenon of the sheets, it is desirable to increase the discharge speed v and to reduce the shift amount a. However, when the discharge speed v is too high, the speed v1 at which the sheet S1 is abutted against the rear end portion stopper 150 is also high. As a result, the reaction force exerted from the rear end portion stopper 150 when the sheet is abutted with the rear end portion stopper 150 increases, resulting in an alignment failure in which the sheet S1 rebounds.

Here, after the sheet S1 has been abutted against the rear end portion stopper 150, the frictional resistance between the sheet S1 and the sheets S2 through Sn due to the movement when the sheets S2 through Sn move toward the rear end portion stopper 150 caused by the inertia imparts a force suppressing rebounding of the sheet S1. Thus, regarding the rebounding alignment failure, it is desirable to lower the collision speed and to increase the shift amount.

Figure 10A:
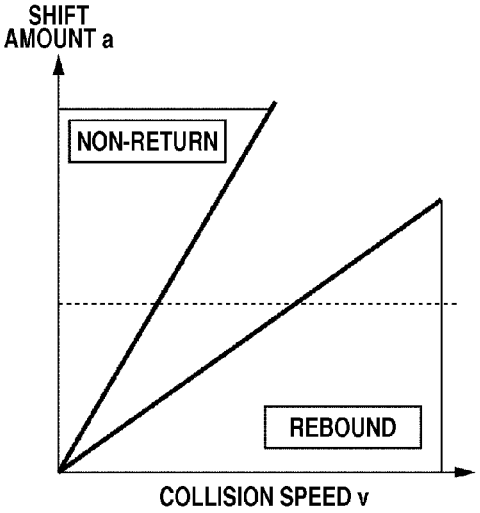
FIGS. 10A, 10B, 10C, and 10D are diagrams illustrating a relationship between collision speed v, shift amount a, rebounding, and non-return in the finisher.

FIG. 10A illustrates regions where the rebounding and non-return phenomenon occur due to the relationship between collision speed v and shift amount a. Herein, when the shift amount a is constant, the collision speed v at which the sheet is abutted against the rear end portion stopper successively decreases, so that the collision speed is plotted horizontally.

Figure 10C:
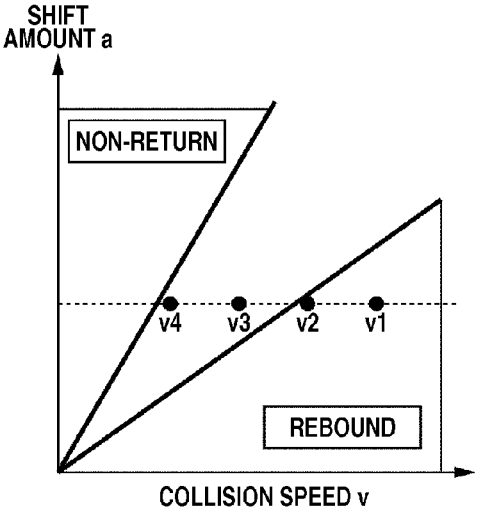
Figure 10B:
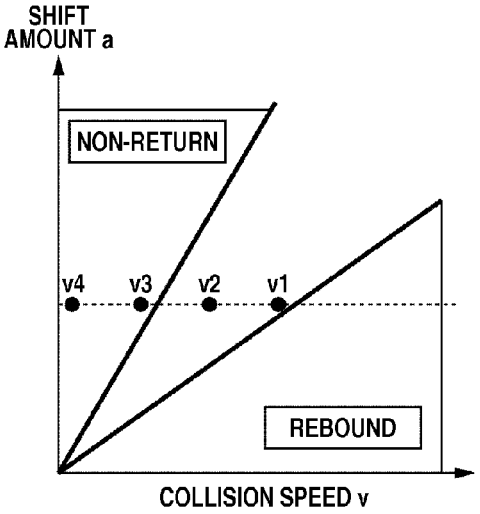

FIG. 10B illustrates a case where the collision speed v1 of the sheet S1 is suppressed so that no rebounding may occur. In this case, the sheet S5 enters the non-return range, resulting in defective alignment. FIG. 10C illustrates a case where the speed is increased so that the sheet S5 may not undergo rebounding. In this case, the sheet S1 enters the rebounding range, resulting in defective alignment.

Figure 10D:
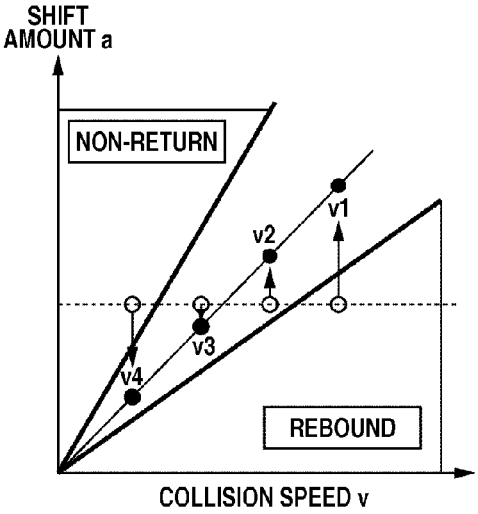

FIG. 10D illustrates a case where the lower the sheet is, i.e., the higher the speed at which it is abutted against the rear end portion stopper is, the larger the shift amount is, and where the higher the sheet is, i.e., the lower the collision speed is, the smaller the shift amount is. In this case, it is possible to effect alignment on the downstream side in the discharge direction without causing non-return and rebounding.

In view of this, in the present exemplary embodiment, the lower the sheet is, i.e., the higher the speed at which it is abutted with the rear end portion stopper 150 is, the larger the shift amount is, and, the higher the sheet is, i.e., the lower the collision speed is, the smaller the shift amount is.

Figure 11A:
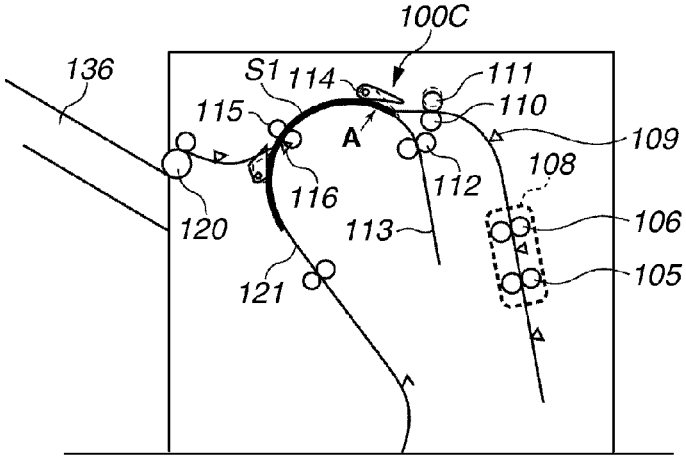
FIGS. 11A, 11B, and 11C are diagrams illustrating a sheet overlap operation by the finisher.
Figure 11B:
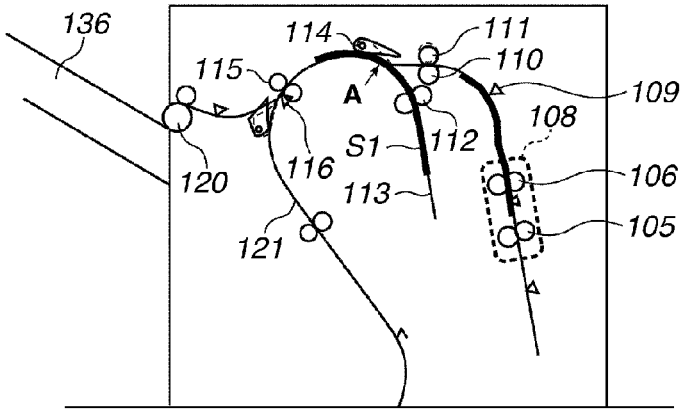
Figure 11C:
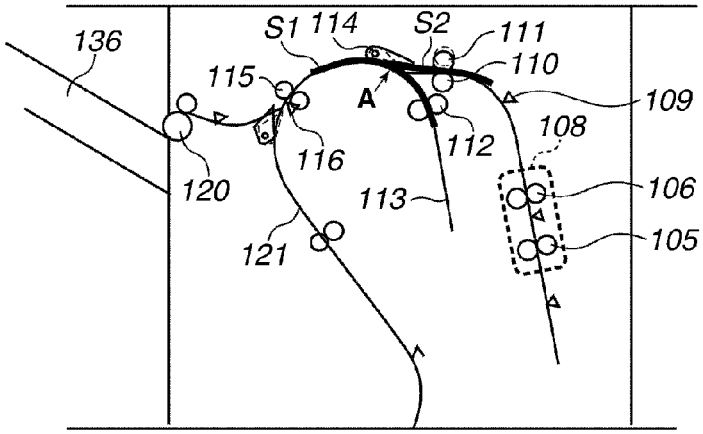

FIGS. 11A, 11B, and 11C illustrate the sheet overlap operation according to the present exemplary embodiment. As illustrated in FIG. 11A, the sheet S1 that has been conveyed by the conveyance roller 110 and the separation roller 111 constituting the sheet conveyance portion, is conveyed to a bundle conveyance path 121 provided between the conveyance roller 110 and the separation roller 111 and the intermediate tray 138. After this, the sheet is conveyed by a first buffer roller pair 115 constituting a first conveyance portion capable of normal and reverse rotation and provided in the bundle conveyance path 121 constituting the sheet conveyance path.

Next, the leading edge position of the sheet S1 is detected by a second buffer sensor 116. Based on this detection timing and previously recognized sheet size information, the trailing edge position of the sheet S1 is branched off from the bundle conveyance path 121, and the sheet is conveyed until it reaches a branching-off point A of the buffer path 113 constituting a standby portion for keeping a plurality of sheets on standby. At this time, a buffer path switching member 114 is switched to the state indicated by the broken line by a drive unit (not illustrated).

Next, after the trailing edge of the sheet S1 has reached the branching-off point A, the first buffer roller pair 115 is caused to make reverse rotation. And, as illustrated in FIG. 11B, the trailing edge of the sheet S1 is guided to the buffer path 113, and the sheet S1 is delivered to the second buffer roller pair 112, which is a second conveyance portion capable of normal and reverse rotation making normal rotation.

As a result, the sheet S1 is drawn into the buffer path (the standby portion) by the second buffer roller pair 112 until the leading edge thereof reaches the position B, and is temporarily kept on standby at that position.

In the present exemplary embodiment, a sheet standby portion 100C for keeping, while the sheet bundle on the intermediate processing tray 138 is being processed, the plurality of sheets to be processed next on standby, is formed by the buffer path 113, the first buffer roller pair 115, and the second buffer roller pair 112.

Next, the sheet S2 to be conveyed next is to be detected by a first buffer sensor 109 which is a detection unit provided on the upstream side in the sheet conveyance direction of the branching-off point A of the bundle conveyance path 121 and the buffer path 113.

When the first buffer sensor 109 detects the sheet S2 conveyed next, the second buffer roller pair 112 is driven to make reverse rotation in conformity with the conveyance of this sheet S2 so that the sheet S1 is overlapped with the sheet S2, and the conveyance of the sheet S1 which has been kept on standby is resumed. As a result, the sheet S1 is returned to the conveyance path, and, as illustrated in FIG. 11C, the sheet S1 and the sheet S2 are overlapped with a predetermined shift amount so that the sheet S2 precedes the sheet S1.

When thus overlapping the sheets S1 and S2, the conveyance start time when re-conveying the sheet S1 is controlled based on an elapsed time using the time of detection of the leading edge position of the sheet S2 by the first buffer sensor 109 as a reference, thereby controlling the shift amount in the overlap.

In overlapping the sheet S3 to be conveyed next to the sheet S2, the sheet bundle consisting of the overlapped sheet S1 and the sheet S2 is conveyed until the trailing edge of the sheet S2 reaches the branching-off point A. After this, processing similar to that of overlapping the sheet S1 and sheet S2 is performed.

Here, in the present exemplary embodiment, the period of time until the re-conveyance start by the second buffer roller pair 112 when overlapping the sheet S3, is set shorter than the period of time when overlapping the sheets S1 and S2. As a result, the shift amount between the sheets S2 and S3 is smaller than the shift amount between the sheets S1 and S2. The overlapping of three or more sheets can be effected through repetition of the processing similar to the above processing.

Next, the buffering processing according to the present exemplary embodiment will be described with reference to the flowchart of FIG. 12.

Figure 13:
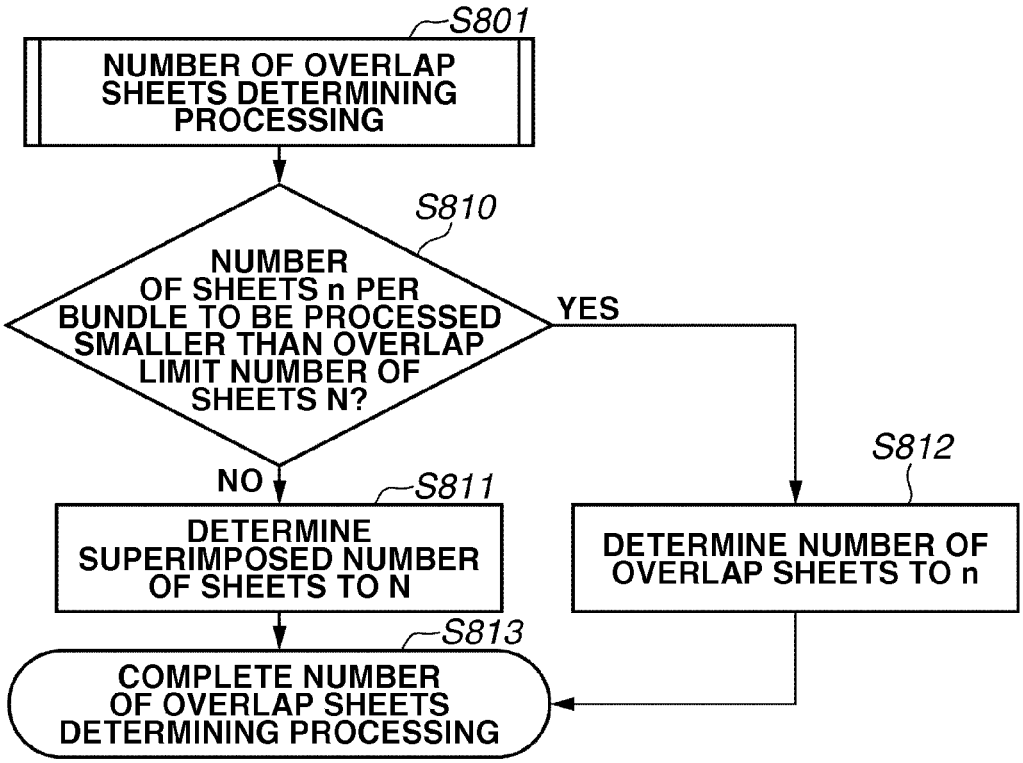
FIG. 13 is a flowchart illustrating a number of overlap sheets determining processing among the buffering processing operations.

When a print job for sheet processing is sent to a copying machine main body 602 in step S800, the processing proceeds to step S801. In step S801, a number of overlap sheets determining processing is performed. In step S810, as illustrated in FIG. 13, in the number of overlap sheets determining processing, the number of sheets n per bundle to be processed is compared with a previously set superimposition limit number of sheets N.

Information on the overlap limit number of sheets N and the number of sheets n to be processed is transmitted from the CPU 629 on the copying machine main body side to the CPU 300 of the finisher control unit 636.

In a case where the number of sheets n per bundle to be processed is larger than the overlap limit number of sheets N (NO in step S810), the number of overlap sheets is determined to be N in step S811, and the number of overlap sheets determining processing is completed in step S813. When the number of sheets n per bundle to be processed is smaller than the overlap limit number of sheet N (YES in step S810), the number of overlap sheets is determined to be n in step S812, and the number of overlap sheets determining processing is completed in step S813.

Figure 12:
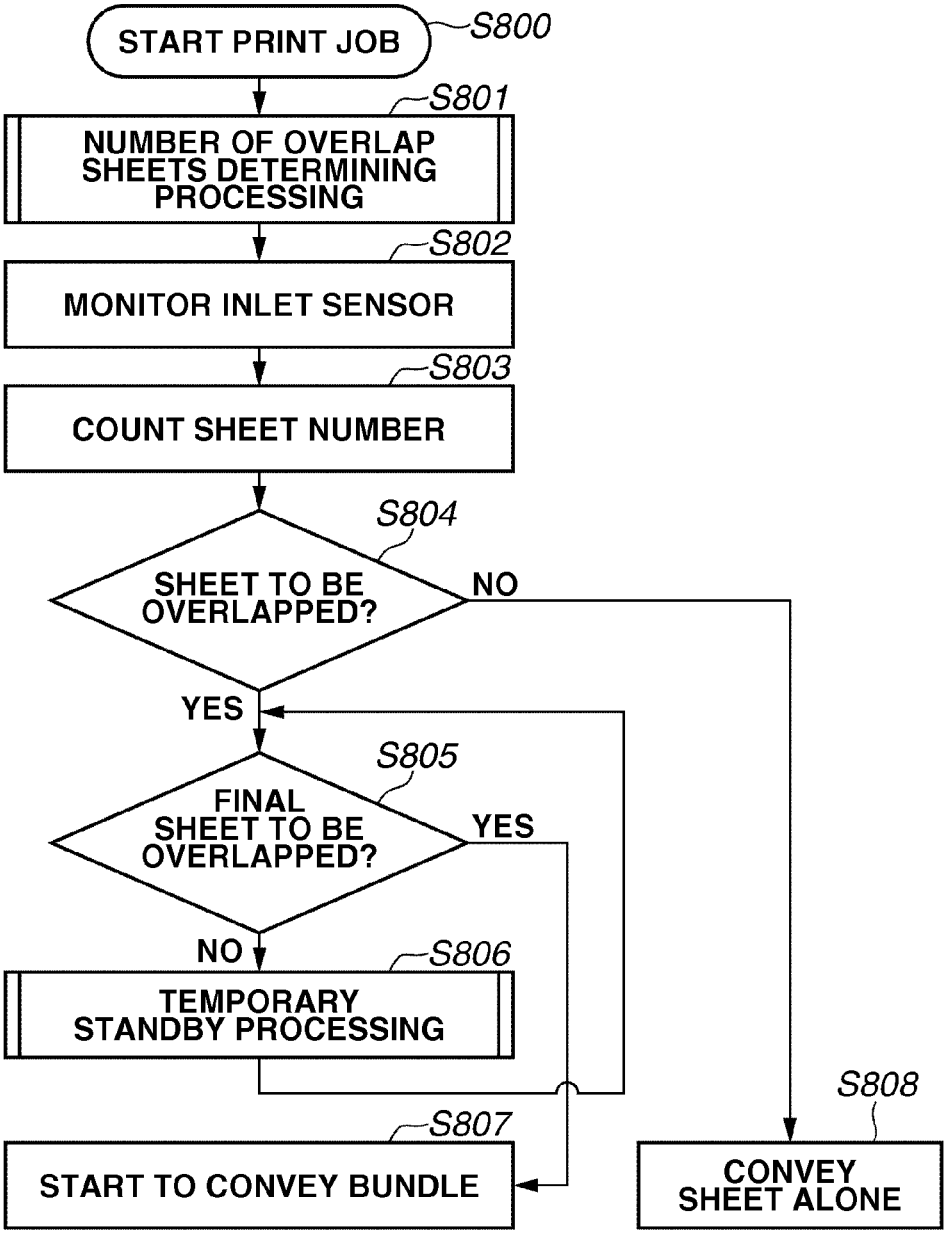
FIG. 12 is a flowchart illustrating buffering processing operations by the finisher.

Next, when, after the completion of this number of overlap sheets determining processing, the discharge of sheets from the copying machine main body 602 to the finisher 100 is started, the inlet sensor 101 is monitored as illustrated in FIG. 12 in step S802, and the sheet numbers of the sheets carried in are counted in step S803.

After this, it is determined whether or not the sheets carried in are the object to be overlapped in step S804. Here, this determination is made by using the overlap limit number of sheets N determined in step S801, the number of sheet n to be processed, and the counted sheet numbers.

Then, the counting is started regarding the foremost sheet discharged from the copying machine main body 602 as the first sheet, and the (k×n+1)th through the (k×n+N)th sheets are determined to be the object to be overlapped. Here, a variable k indicates the number of copies to be generated. It is an integer ranging from 1 to the number of generated copies.

In a case where the overlap limit number of sheets n is set in the overlap limit number of sheets determining processing, N is replaced by n. This also applies to the subsequent processing. When the sheet is not determined to be the object to be overlapped (NO in step S804), the sheet is conveyed alone as it is to the intermediate processing tray 138 in step S808.

When the sheet is determined to be the object to be overlapped (YES in step S804), it is determined whether the sheet is the final sheet to be overlapped next in step S805. The term "final sheet" means the final sheet when considered per copy. It indicates the (k×n+N) th sheet. In the following, unless otherwise specified, the term "final sheet" means the final sheet when considered per bundle to be processed.

When a sheet is determined not to be the final sheet (NO in step S805), i.e., in the case of a sheet among the (k×n+1)th through the (k×n+N−1)th sheets, the processing proceeds to a temporary standby processing in step S806.

Figure 14:
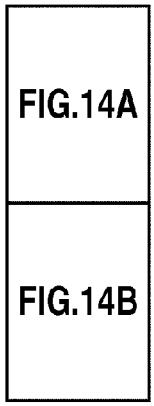
FIG. 14 (14A+14B) is a flowchart illustrating a temporary standby processing among the buffering processing operations.
Figure 14A:
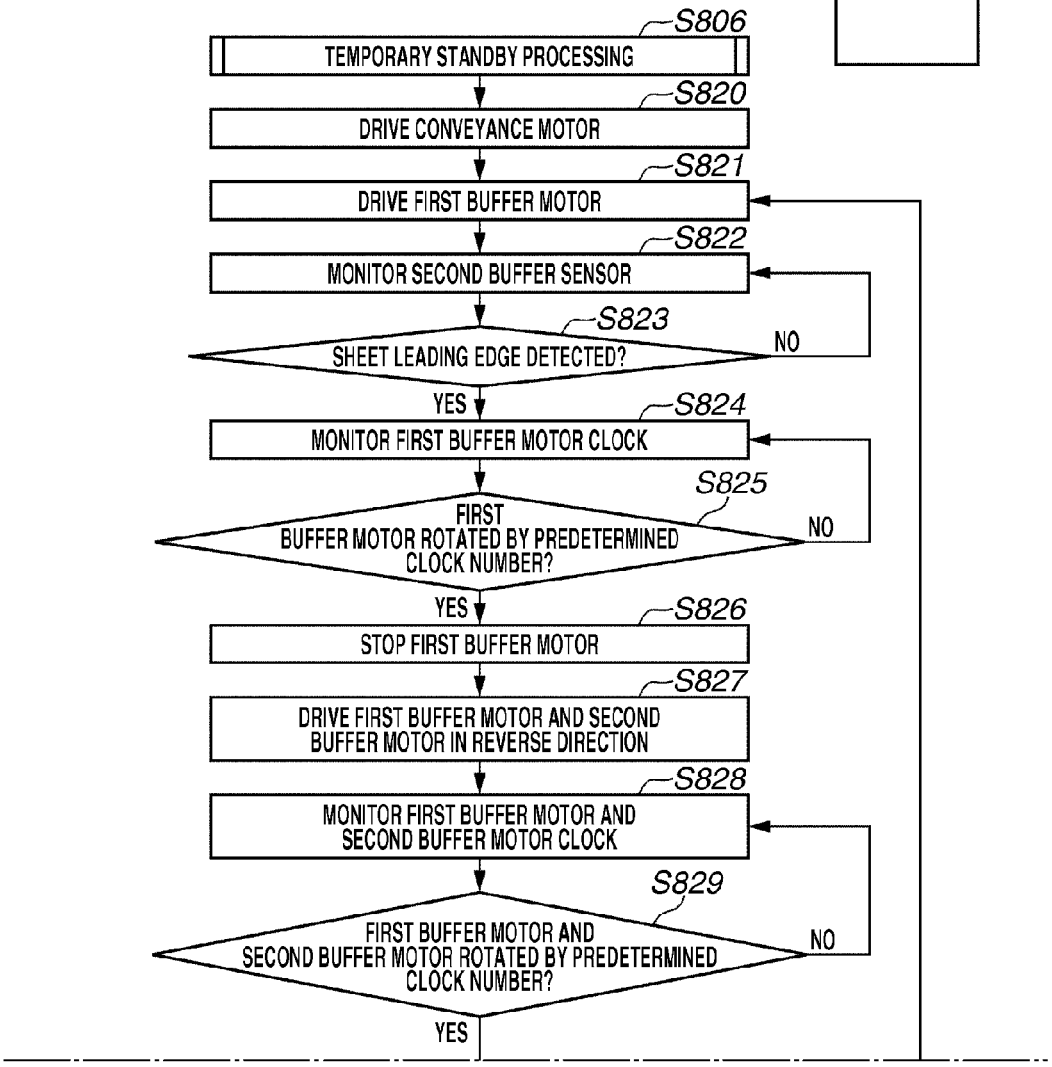
Figure 14B:
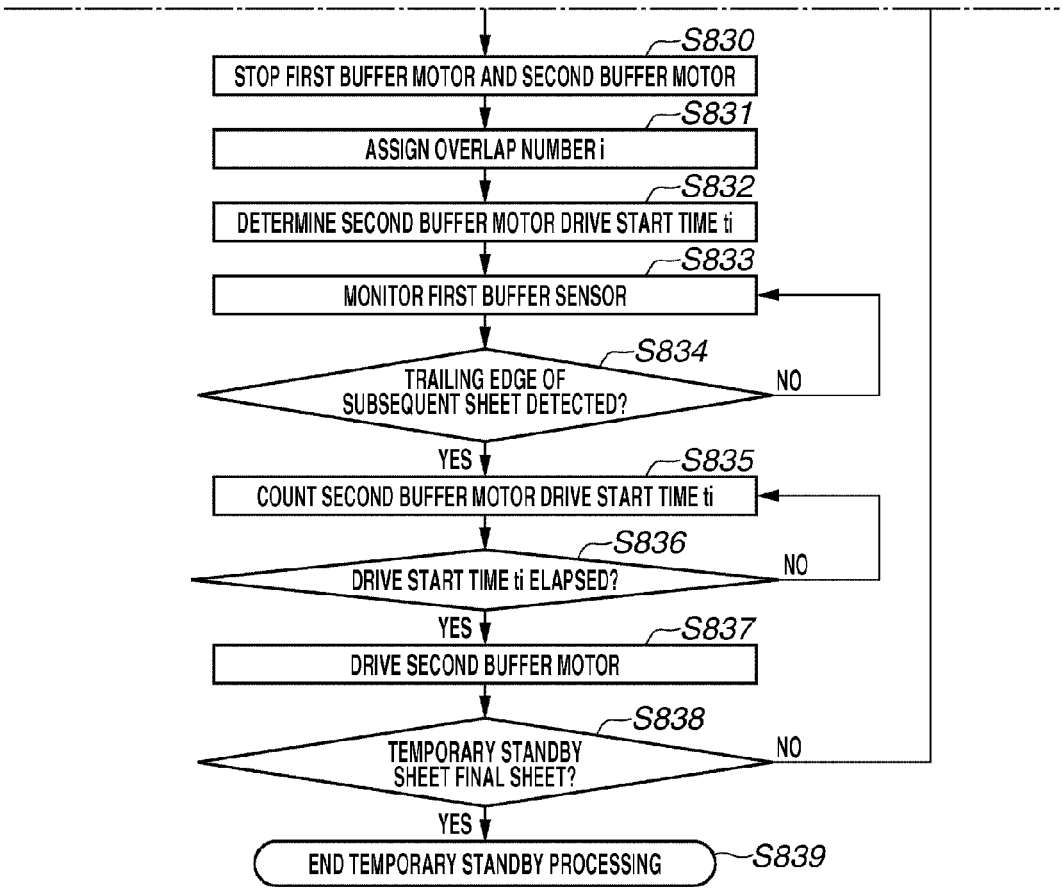

As illustrated in FIG. 14, in this temporary standby processing, the conveyance motor 320 is first driven to rotate the conveyance roller 110 in step S820. Next, the first buffer motor 321 is driven so as to cause the first buffer roller pair 115 to make normal rotation to convey the sheets in step S821. After this, the second buffer sensor 116 is monitored in step S822. When the second buffer sensor 116 detects the leading edge of the conveyed sheet (YES in step S823), the clock number of the first buffer motor 321 is monitored so as to convey the sheet by a predetermined amount in step S824.

When the first buffer motor 321 has rotated by a predetermined number of clocks (YES in step S825), the trailing edge of the sheet S1 reaches the branching-off point A which is the inlet of the buffer path 113 as illustrated in FIG. 11A. Next, the first buffer motor 321 is temporarily stopped in step S826. After this, the first buffer motor 321 and the second buffer motor 322 are driven to rotate in the reverse direction in step S827. As a result, the first buffer roller pair 115 makes reverse rotation, and at the same time, the second buffer roller pair 112 makes normal rotation, and, as illustrated in FIG. 11B, the trailing edge of the sheet S1 is guided to the buffer path 113.

Next, the clock numbers of the first buffer motor 321 and the second buffer motor 322 are monitored so as to perform reverse conveyance of the sheet until its leading edge reaches the position B in step S828. Then, the first buffer motor 321 and the second buffer motor 322 rotate by a predetermined number of clocks and when the leading edge of the sheet reaches the position B (YES in step S829), the first buffer motor 321 and the second buffer motor 322 are temporarily stopped in step S830.

Next, the processing proceeds to the processing of determining the period of time until the driving of the second buffer motor 322 is resumed. For this processing, an overlap number i is first assigned to each sheet conveyed in step S831. Each of the sheets to be overlapped is expressed as (k×n+1), the overlap number i for the first sheet to be overlapped is 1. Thereafter, the overlap number is assigned successively. From this definition, the overlap number i of the (k×n+N−1)th sheet is N−1.

In the present exemplary embodiment, the period of time ti until the driving of the second buffer motor 321 is resumed based on the defined overlap number i, is set as: $ti=(N-i)\times T/(N-1)$. Here, since the time T is constant, the ti, which is the driving resuming time, is a function of the overlap number i. The larger the overlap number i is, the shorter the period of time until the resuming of the driving is. As described above, the period of time until the resuming of the driving of the second buffer motor 322 is determined based on the overlap number i in step S832.

Subsequently, the first buffer sensor 109 is monitored in step S833, and the moment that the leading edge of the second sheet conveyed next passes the first buffer sensor 109 is detected in step S834. When the first buffer sensor 109 detects the leading edge of the sheet (YES in step S834), in step S835, the counting of the driving resuming time ti determined in step S832 is started using this detection time as a 0-reference.

After this, when the driving resuming time ti has elapsed (YES in step S836), in step S837, the driving of the second buffer motor 322 is resumed, and the second buffer roller pair 112 is cause to make reverse rotation. As a result, the conveyance of the sheet S1, which has been temporarily on standby, is resumed, and two sheets are overlapped with a predetermined shift amount as illustrated in FIG. 11C.

Next, in step S838, it is determined whether or not this sheet is the final sheet to be temporarily kept on standby, i.e., whether or not it is the (k×n+N−1)th sheet. When it is not the final sheet (NO in step S838), the processing returns to step S821, and the above-described processing of steps S821 through S838 is repeatedly performed. When the sheet is the final sheet to be temporarily kept on standby, i.e., when it is the (k×n+N−1)th sheet (YES in step S838), in step S839, the temporary standby processing is ended.

After the temporary standby processing has been thus ended, the final sheet to be overlapped, i.e., the (k×n+N)th sheet is waited for to be conveyed as illustrated in FIG. 12. Then, when the final sheet to be overlapped has been conveyed (YES in step S805), in step S807, the final sheet is joined with the sheet overlapped by this temporary standby processing to be conveyed as a bundle.

As described above, in the present exemplary embodiment, the larger the overlap number i is, the shorter the period of time until the resuming of the driving is. In other words, as the overlap number i is larger, the timing with which the reverse rotation of the second buffer roller pair 112 is started is successively hastened.

As a result, when sheets are conveyed while successively shifted from each other in the sheet conveyance direction, the lower the sheet is positioned, i.e., the higher the collision speed is, the larger the shift amount can be made, and the higher the sheet is positioned, i.e., the lower the collision speed is, the smaller the shift amount can be made. As a result, it is possible to cause all the sheets discharged toward the rear end portion stopper 150 in an overlapped state to reach the rear end portion stopper 150, and to stop the sheets without rebounding.

That is, as in the present exemplary embodiment, by conveying the plurality of sheets to be processed next that are on standby at the sheet standby portion 100C in a state in which the sheets are overlapped with the shift amount successively reduced, it is possible to perform the sheet standby processing without causing any defective alignment.

As a result, when performing sheet stitching processing on an image forming apparatus with a high image forming speed and a small sheet discharge interval without stopping the output from the image forming apparatus even while the stitching processing is being performed, it is possible to perform the sheet stitching processing without causing any deterioration in quality.

Although the finisher 100 according to the present exemplary embodiment described above employs the switchback system, in which a sheet is reversely conveyed halfway in conveyance and temporarily kept on standby in a standby path (buffer path 113), the present invention is not limited thereto. For example, the present invention is also applicable to a finisher employing the wrapping system illustrated in FIG. 15A and the plurality-of-buffer-path system illustrated in FIG. 15B.

Figure 15A:
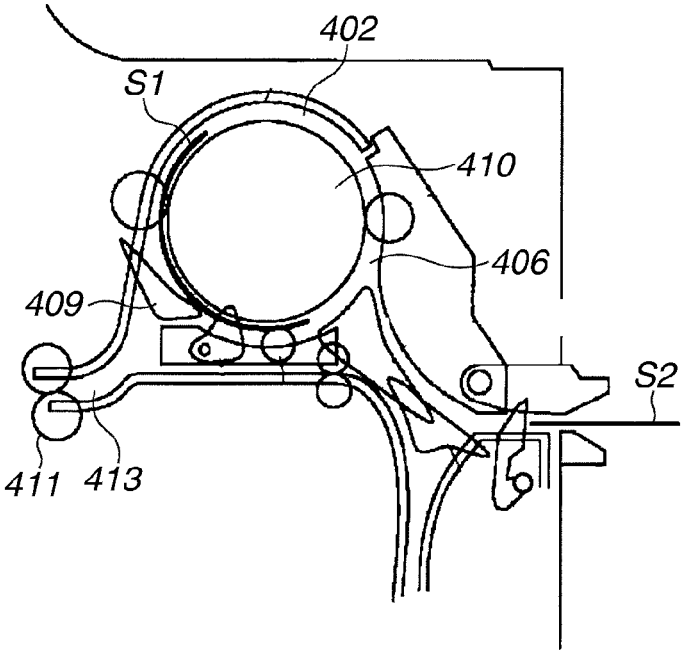
FIGS. 15A and 15B are diagrams illustrating another configuration of the above finisher.

Here, in the finisher employing the wrapping system, when performing buffering processing on a sheet, the preceding sheet S1 is, as illustrated in FIG. 15A, first kept on standby in a circular path 402 formed on the peripheral surface of a buffer roller 410 that is a rotary member. And, in conformity with the conveyance of the subsequent sheet S2, the sheet S1, which has been kept on standby, is overlapped with the sheet S2 at a joining point 406 to be conveyed in the overlapped state.

The above operation is repeated on a requisite number of sheets, and when the requisite number of sheets have been overlapped, a conveyance path switching member 409 is switched over, and a sheet bundle consisting of overlapped sheets is conveyed by a conveyance roller 411 provided in a bundle conveyance path 413.

In this wrapping type finisher, the sheet standby portion is formed by the circular path 402, which is a standby portion formed on the peripheral surface of the buffer roller 410, the conveyance roller 411, which is the first conveyance portion, and the buffer roller 410, which is the second conveyance portion.

By changing, for example, the timing at which the rotation of the buffer roller 410 is started, and the rotation speed of the buffer roller 410, it is possible to convey a plurality of sheets in an overlapped state with the shift amount successively reduced.

Figure 15B:
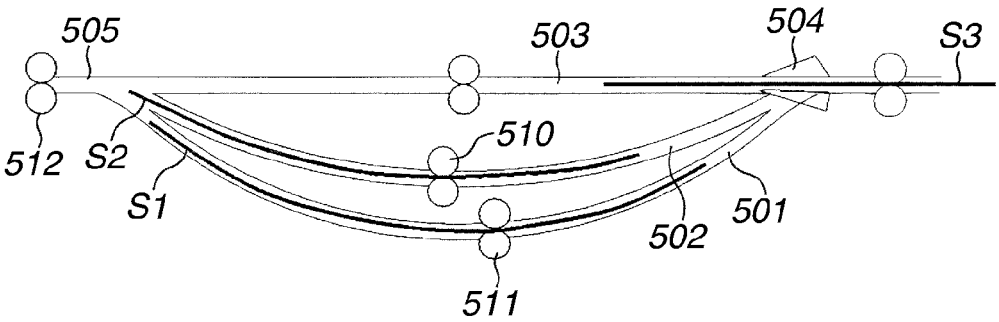

In the finisher employing the buffer path system equipped with buffer paths which are a plurality of standby paths, the overlapping of sheets is performed, as illustrated in FIG. 15B, by using a number of buffer paths corresponding to the number of sheets to be overlapped. Herein, a case where three sheets are overlapped will be described by way of example. When the sheets are conveyed, the first preceding sheet S1 is guided to a first buffer path 501, and a second preceding sheet S2 is guided to a second buffer path 502 by using a path switching member 504, and the sheets are temporarily kept on standby.

After this, a final sheet S3 to be overlapped passes through a third buffer path 503, and, in conjunction with its passing through a joining path 505, a conveyance roller 510 provided in the first buffer path 501 and a conveyance roller 511 provided in the second buffer path 502 are driven. As a result, the sheets S1 and S2 that have been on standby in the first and second buffer paths 501 and 502 are overlapped on the final sheet S3 in the joining path 505. After this, the three sheets S1 through S3 are conveyed by the conveyance roller 512 in an overlapped state.

Also in a case where a larger number of sheets are overlapped, there are provided buffer paths corresponding to the number of sheets to be overlapped. The sheets are guided to their respective buffer paths, and temporarily kept on standby. Then, the sheets are conveyed in conformity with the final sheet to be overlapped before being joined together. Thus, an operation similar to that described above is conducted.

In this plurality-of-buffer-path type finisher, the sheet standby portion includes the first and second buffer paths 501 and 502 constituting the standby portion, the conveyance roller 512 constituting the first conveyance portion, and the conveyance rollers 510 and 511 constituting the second conveyance portion. With this configuration, by changing, for example, the timing at which the rotation of the conveyance rollers 510 and 511 is started, and the rotation speed of the conveyance rollers 510 and 511, it is possible to convey a plurality of sheets in an overlapped state while successively reducing the shift amount.

Figure 16:
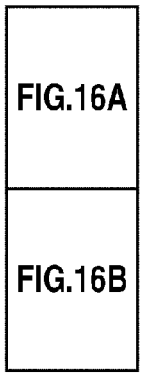
FIG. 16 (16A+16B) is a flowchart illustrating a temporary standby processing in the buffering processing by a finisher according to a second exemplary embodiment of the present invention.
Figure 16A:
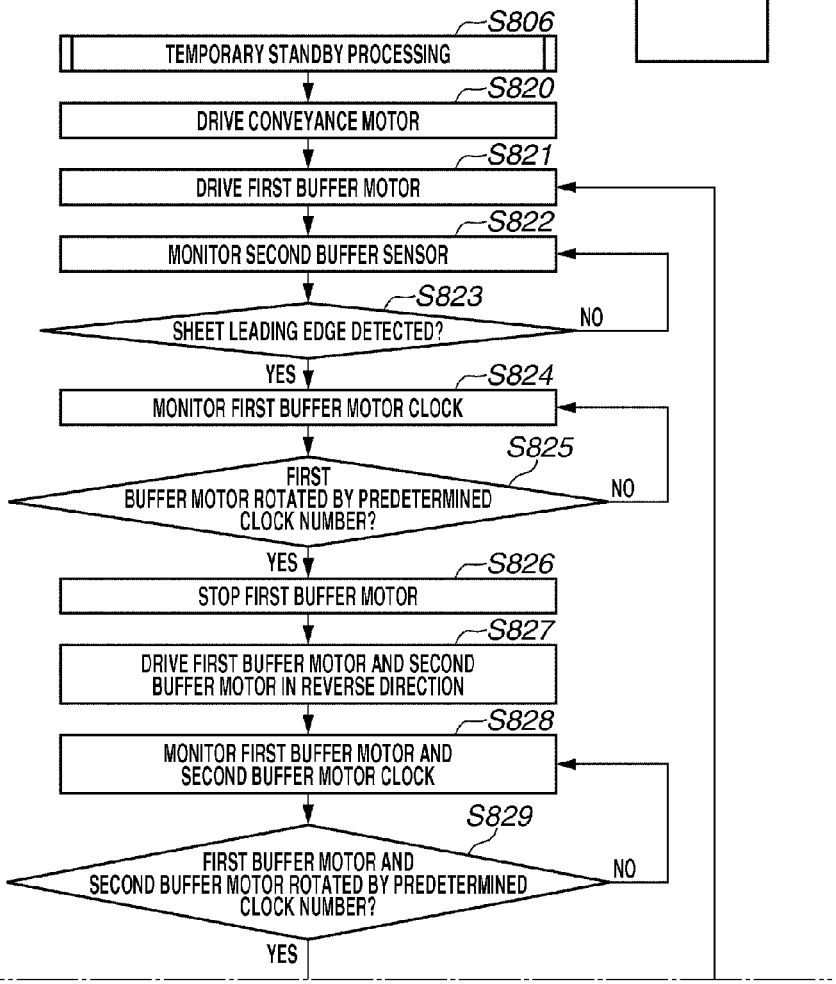
Figure 16B:
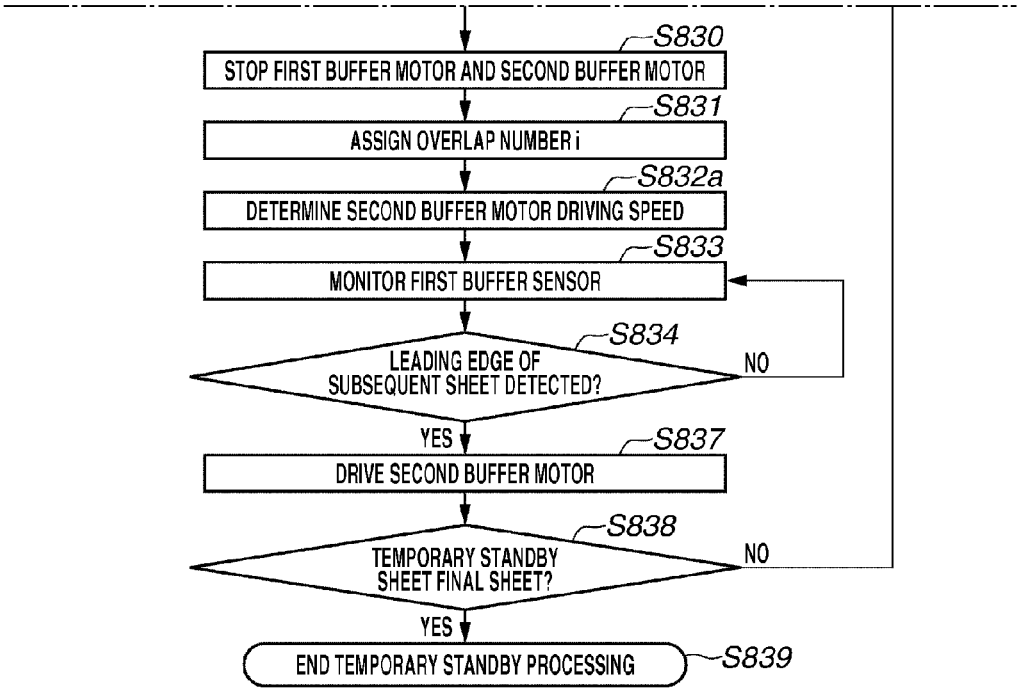

Next, a second exemplary embodiment of the present invention will be described. FIG. 16 (16A+16B) is a flowchart illustrating the temporary standby processing in the buffering processing by a finisher according to the present exemplary embodiment. Next, the temporary standby processing according to the present exemplary embodiment will be described with reference to FIG. 16. In FIG. 16, the processing up to the overlap number i assignment processing of steps S820 through S831 is the same as the temporary standby processing according to the first exemplary embodiment described with reference to FIG. 14, and a description thereof will be omitted.

In the present exemplary embodiment, after the overlap number i assignment processing in step S831, the processing proceeds to step S832*a*. In step S832*a*, the processing of determining the driving speed of the second buffer motor 322 is performed. Here, the processing of determining the driving speed of the second buffer motor 322 is a processing for determining the driving speed of the second buffer motor 322 when resuming the conveyance of the sheet S1, which has been kept on standby.

In this driving speed determining processing, it is assumed that the movement amount by which the preceding sheet is conveyed from the temporarily standby position indicated at B in FIG. 11B until the completion of the overlapping is L (constant), and that the time it takes from the driving start of the second buffer motor 322 to the completion of the overlapping is t2.

The driving speed of the second buffer motor 322 is controlled so that the preceding sheet moves by the movement amount L during the time t2. Here, in the present exemplary embodiment, the larger the overlap number is, the faster the driving speed of the second buffer motor 322, i.e., the rotation speed of the second buffer roller pair 112 is, thereby reducing the overlapping amount.

The time t2 is to be expressed as follows: [T2+a (1−i/N)]. Here, T2 and a are constant amounts. The time T2 is the time taken from the driving start of the second buffer motor 322 to the completion of the overlapping when the preceding sheet and the subsequent sheet are overlapped with no shifting therebetween.

After the processing of determining the driving speed of the second buffer motor 322, the first buffer sensor 109 is monitored in step S833, and the leading edge of the sheet conveyed next is detected in step S834. The moment that the leading edge is detected is regarded as the driving start time for the second buffer motor 322. After this, in step S837, the second buffer motor 322 is driven at a speed determined in step S832*a*. The processing thereafter is the same as that of steps S838 and S839 described with reference to FIG. 14, and a description thereof will be omitted.

In this way, in the present exemplary embodiment, the larger the overlap number is, the faster the driving speed of the second buffer motor 322 is, whereby the sheet conveyance speed at the time of reverse rotation of the second buffer roller pair 115 is successively increased. This makes it possible to successively reduce the shift amount and to perform the sheet standby processing without causing any defective alignment.

Figure 17:
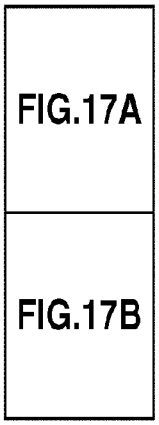
FIG. 17 (17A+17B) is a flowchart illustrating a temporary standby processing in the buffering processing by a finisher according to a third exemplary embodiment of the present invention.
Figure 17A:
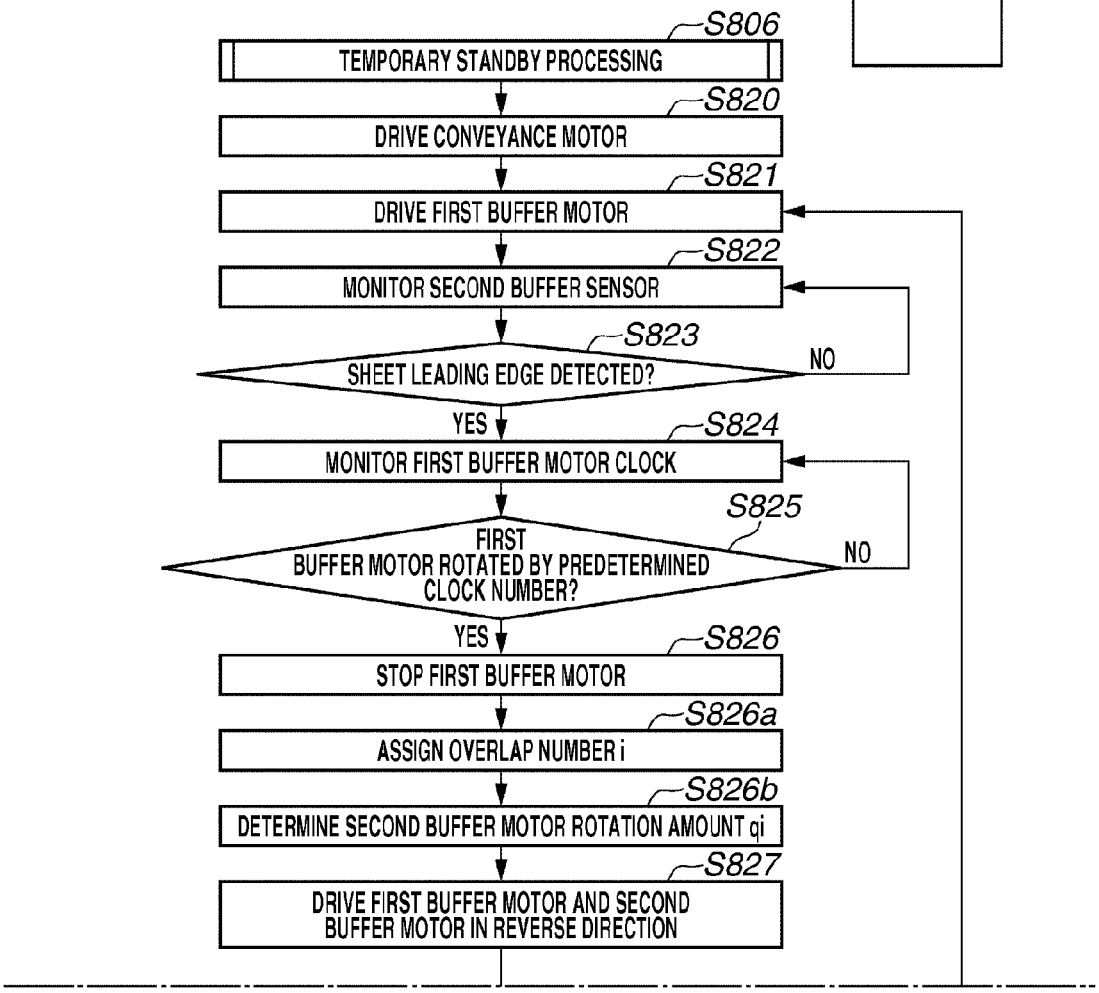
Figure 17B:
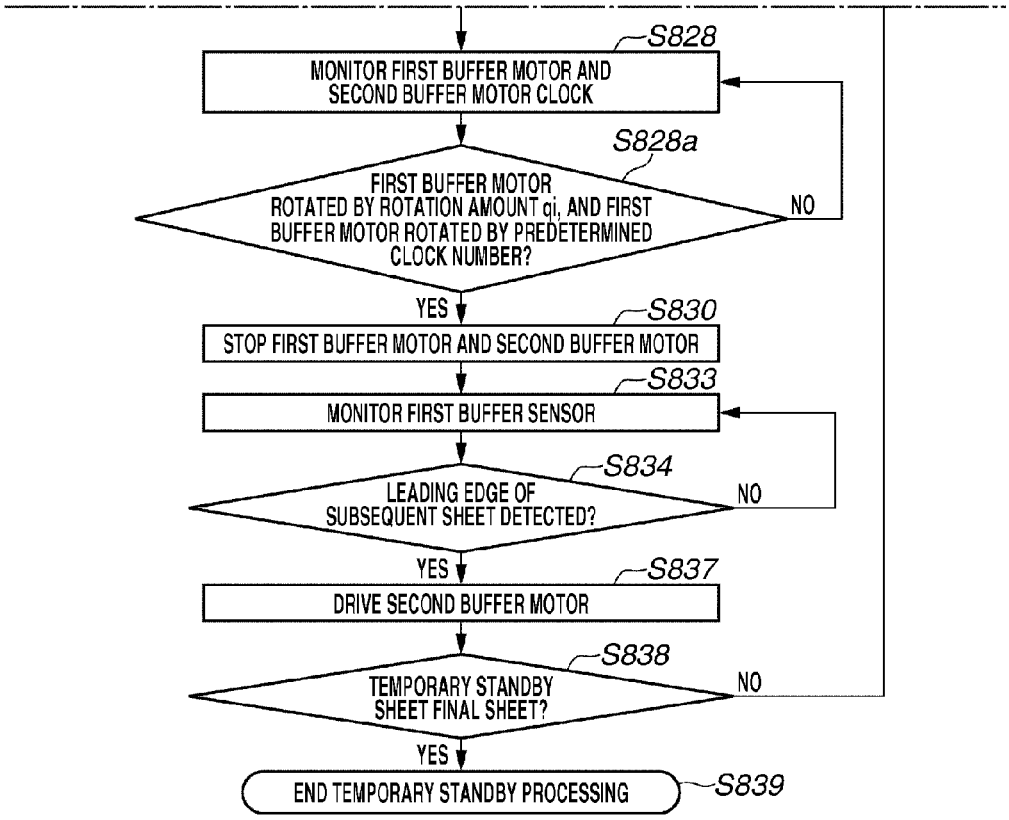
Figure 18:
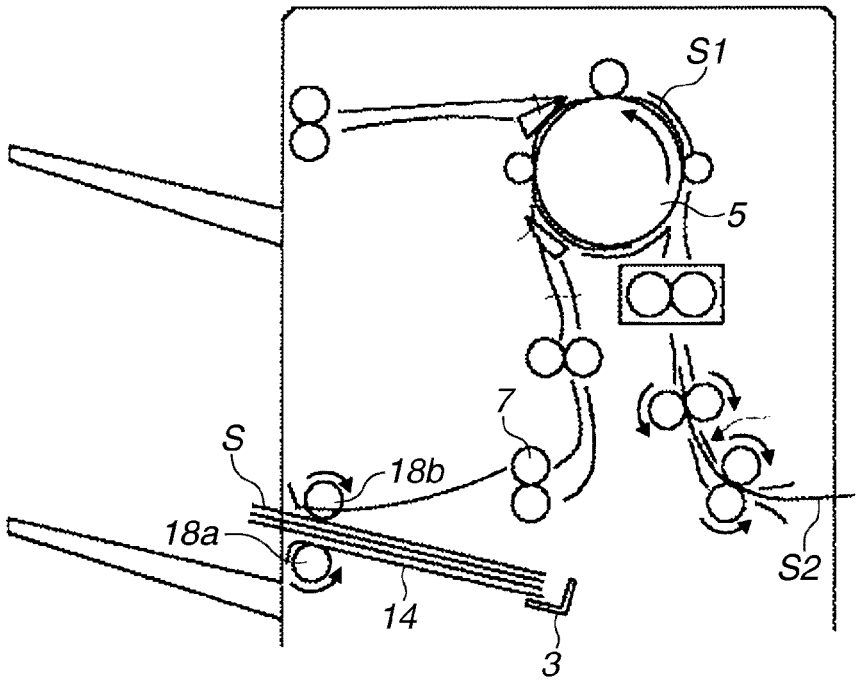
FIG. 18 is a diagram illustrating a conventional sheet processing apparatus.
Figure 19A:
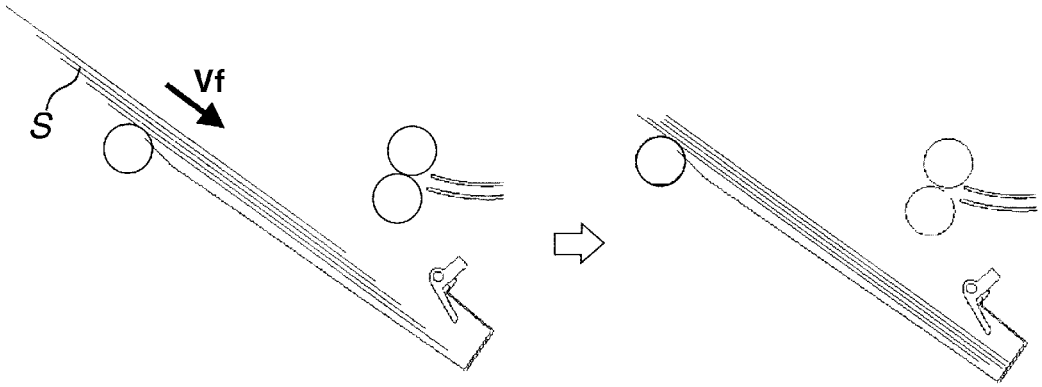
FIGS. 19A and 19B are diagrams illustrating a problem in the conventional sheet processing apparatus.
Figure 19B:
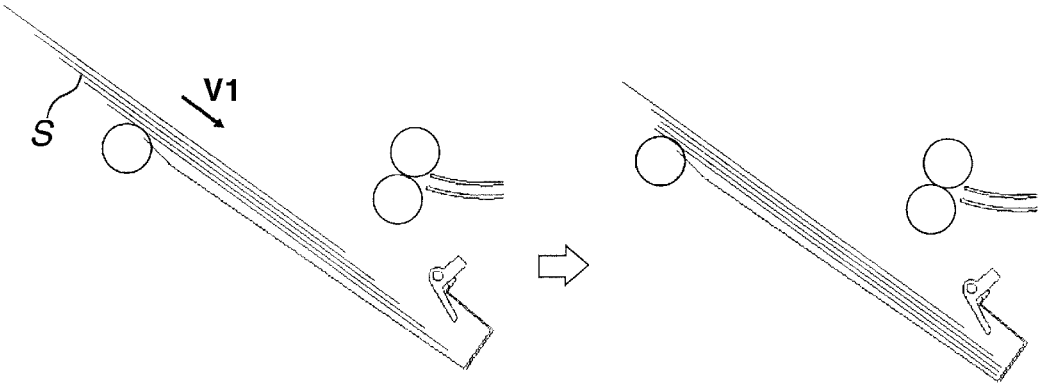

Next, the third exemplary embodiment of the present invention will be described. FIG. 17 (17A+17B) is a flowchart illustrating temporary standby processing in buffering processing by a finisher according to the present exemplary embodiment. Next, the temporary standby processing according to the present exemplary embodiment will be described with reference to FIG. 17.

In FIG. 17, the processing of steps S820 through S826, i.e., from when the sheet trailing edge has passed through the inlet of the buffer path 113 to when the first buffer motor 321 is temporarily stopped, is similar to the temporary standby processing according to the first exemplary embodiment described with reference to FIG. 14, and a description thereof will be omitted.

In the present exemplary embodiment, the first buffer motor 321 is thus temporarily stopped in step S826, and then the processing proceeds to step S826*a*. In step S826*a*, the assignment of the overlap number i in the temporary standby processing is performed. Next, the processing proceeds to step S826*b*. In step S826*b*, the processing of determining the rotation amount qi of the second buffer motor 322 is performed. In this processing of determining the rotation amount qi of the second buffer motor 322, the second buffer motor 322 is reversely driven, and the rotation amount of the second buffer motor 322 when drawing the sheet into the buffer path 113 is determined for each overlap number i.

Here, the rotation amount of the second buffer motor 322 for each overlap number i is defined as qi. This qi can be defined as: $Q-\alpha\times(i-1)$. In this definition, Q is the rotation amount when i=1, and it is of a constant value. $\alpha$ is a constant satisfying the condition: $r\times\alpha\times N<a1$. r is the radius of the second buffer roller pair 112, and a1 is the shift amount between the sheets S1 and S2. That is, in the present exemplary embodiment, the larger the overlap number is, the smaller the rotation amount of the second buffer motor 322 is, and the smaller the amount of sheets drawn into the buffer path 113 is.

After the rotation amount qi is determined, the first buffer motor 321 and the second buffer motor 322 are reversely driven in step S827. As a result, as illustrated in FIG. 11B, the trailing edge of the sheet S1 is guided to the buffer path 113.

Next, the clock number of the first buffer motor 321 and of the second buffer motor 322 is monitored so as to convey the sheet reversely by a predetermined amount in step S828, and the sheet is conveyed by an amount corresponding to the rotation amount qi. After this, the first buffer sensor 109 is monitored in step S833, and after that, similar processing to that illustrated in FIG. 14 is performed.

In this way, in the present exemplary embodiment, the larger the overlap number is, the smaller the rotation amount of the second buffer motor 322 is, and the smaller the amount of sheets drawn in by the second buffer roller pair 112 is. By thus reducing the drawing-in amount, it is possible to reduce the overlapping amount when the sheets are overlapped, making it possible to perform the sheet standby processing without causing any defective alignment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2011-179663 filed Aug. 19, 2011 and No. 2012-168145 filed Jul. 30, 2012, which are hereby incorporated by reference herein in their entirety.

What is claimed is:

1. A sheet processing apparatus configured to process sheets comprising:

a sheet conveyance portion configured to convey a sheet;

a sheet stacking portion on which sheets, conveyed by the sheet conveyance portion, to be processed are stacked;

an overlapping portion, arranged between the sheet stacking portion and the sheet conveyance portion, configured to overlap a plurality of sheets to be discharged on the sheet stacking portion one on the other and keep the plurality of sheets on standby while preceding sheets on the sheet stacking portion are being processed;

an end portion stopper against which one end in a sheet conveyance direction of each of the plurality of sheets conveyed from the overlapping portion to the sheet stacking portion is abutted; and a control unit configured to control the overlapping portion so that the overlapping portion overlaps the sheets such that when the plurality of sheets are discharged onto the stacking portion, an end of a first sheet of the plurality of sheets being lowermost on the stacking portion, to be abutted against the end portion stopper, is closer to the end portion stopper than an end of a second sheet on the first sheet, to be abutted against the end portion stopper, and the end of the second sheet is closer to the end portion stopper than an end of a third sheet on the second sheet, to be abutted against the end portion stopper, and the end of the third sheet is closer to the end portion stopper than an end of a fourth sheet on the third sheet, to be abutted against the end portion stopper, a shift amount between the end of the first sheet and the end of the second sheet being larger than a shift amount between the end of the third sheet and the end of the fourth sheet, wherein the overlapping portion includes:

a standby portion branching off from a sheet conveyance path provided between the sheet stacking portion and the sheet conveyance portion and configured to keep on standby the plurality of sheets in the overlapped state;

a first conveyance portion configured to convey from the standby portion the plurality of sheets that have been kept on standby at the standby portion; and a second conveyance portion, provided in the standby portion, configured to convey the plurality of sheets kept on the standby portion to the first conveyance portion, wherein the control unit controls the first conveyance portion so that the sheet conveyed from the sheet conveyance portion is conveyed to the sheet stacking portion with normal rotation of the first conveyance portion and that the sheets are conveyed to the standby portion with reverse rotation thereof, and controls the second conveyance portion so that the sheets conveyed with reverse rotation of the first conveyance portion are conveyed into the standby portion with normal rotation of the second conveyance portion and that the sheet conveyed into the standby portion are conveyed to the first conveyance portion with reverse rotation of the second conveyance portion.

2. The sheet processing apparatus according to claim 1, further comprising a detection unit provided on an upstream in the sheet conveyance direction of a branching-off point of the sheet conveyance path and the standby portion and configured to detect a sheet, wherein the control unit controls, based on a signal from the detection unit, the second conveyance portion to make reverse rotation so as to convey the sheet on the standby portion to the first conveyance portion.

3. The sheet processing apparatus according to claim 2, wherein the control unit successively changes timing at which the reverse rotation of the second conveyance portion is started so as to successively change the shift amount.

4. The sheet processing apparatus according to claim 2, wherein the control unit successively changes a sheet conveyance speed at a time of the reverse rotation of the second conveyance portion so as to successively change the shift amount.

5. The sheet processing apparatus according to claim 2, wherein the control unit successively changes an amount of conveyance of the sheet into the standby portion with the normal rotation of the second conveyance portion so as to successively change the shift amount.

6. The sheet processing apparatus according to claim 1, the control unit controls the overlapping portion so that the shift amount between the end of the second sheet and the end of the third sheet is larger than a shift amount between the end of the third sheet and the end of the fourth sheet.

7. The sheet processing apparatus according to claim 6, wherein the overlapping portion can overlap at least five sheets.

8. The sheet processing apparatus according to claim 1, wherein the control unit controls the overlapping portion so that the shift amount between the end of the first sheet and the end of the second sheet is larger than a shift amount between the end of the second sheet and the end of the third sheet.

9. An image forming apparatus comprising:

an image forming portion configured to form an image on a sheet;

a sheet conveyance portion configured to convey a sheet with an image formed thereon;

a sheet stacking portion on which a sheet conveyed by the sheet conveyance portion is stacked;

an overlapping portion, arranged between the sheet stacking portion and the sheet conveyance portion, configured to overlap a plurality of sheets to be discharged on the sheet stacking portion one on the other and keep the plurality of sheets on standby while preceding sheets on the sheet stacking portion are being processed;

an end portion stopper against which one end in a sheet conveyance direction of each of the plurality of sheets conveyed from the overlapping portion to the sheet stacking portion; and a control unit configured to control the overlapping portion so that the overlapping portion overlaps the sheets such that when the plurality of sheets are discharged onto the stacking portion, an end of a first sheet of the plurality of sheets being lowermost on the stacking portion, to be abutted against the end portion stopper, is closer to the end portion stopper than an end of a second sheet on the first sheet, to be abutted against the end portion stopper, and the end of the second sheet is closer to the end portion stopper than an end of a third sheet on the second sheet, to be abutted against the end portion stopper, and the end of the third sheet is closer to the end portion stopper than an end of a fourth sheet on the third sheet, to be abutted against the end portion stopper, a shift amount between the end of the first sheet and the end of the second sheet being larger than a shift amount between the end of the third sheet and the end of the fourth sheet wherein the overlapping portion includes:

a standby portion branching off from a sheet conveyance path provided between the sheet stacking portion and the sheet conveyance portion and configured to keep on standby the plurality of sheets in the overlapped state;

a first conveyance portion configured to convey from the standby portion the plurality of sheets that have been kept on standby at the standby portion; and a second conveyance portion, provided in the standby portion, configured to convey the plurality of sheets kept on the standby portion to the first conveyance portion, wherein the control unit controls the first conveyance portion so that the sheet conveyed from the sheet conveyance portion is conveyed to the sheet stacking portion with normal rotation of the first conveyance portion and that the sheets are conveyed to the standby portion with reverse rotation thereof, and controls the second conveyance portion so that the sheets conveyed with reverse rotation of the first conveyance portion are conveyed into the standby portion with normal rotation of the second conveyance portion and that the sheets conveyed into the standby portion are conveyed to the first conveyance portion with reverse rotation of the second conveyance portion.

10. The image forming apparatus according to claim 9, further comprising a detection unit provided on an upstream side in the sheet conveyance direction of a branching-off point of the sheet conveyance path and the standby portion and configured to detect a sheet, wherein the control unit controls, based on a signal from the detection unit, the second conveyance portion to make reverse rotation so as to convey the sheet on the standby portion to the first conveyance portion.

11. The image forming apparatus according to claim 10, wherein the control unit successively changes timing at which the reverse rotation of the second conveyance portion is started so as to successively change the shift amount.

12. The image forming apparatus according to claim 10, wherein the control unit successively changes sheet conveyance speed at a time of the reverse rotation of the second conveyance portion so as to successively change the shift amount.

13. The image forming apparatus according to claim 10, wherein the control unit successively changes an amount of drawing-in of the sheet into the standby portion with the normal rotation of the second conveyance portion so as to successively the shift amount.

14. The sheet processing apparatus according to claim 9, the control unit controls the overlapping portion so that the shift amount between the end of the second sheet and the end of the third sheet is larger than a shift amount between the end of the third sheet and the end of the fourth sheet.

15. A sheet processing apparatus configured to process sheets comprising:

a sheet conveyance portion configured to convey a sheet;

a sheet stacking portion on which sheets, conveyed by the sheet conveyance portion, to be processed are stacked;

an overlapping portion, arranged between the sheet stacking portion and the sheet conveyance portion, configured to overlap a plurality of sheets to be discharged on the sheet stacking portion one on the other and keep the plurality of sheets while preceding sheets on the sheet stacking portion are being processed, wherein the overlapping portion including, a standby portion branching off from a sheet conveyance path provided between the sheet stacking portion and the sheet conveyance portion and configured to keep on standby the plurality of sheets in the overlapped state, a first conveyance portion configured to convey from the standby portion the plurality of sheets that have been kept on standby at the standby portion, and a second conveyance portion, provided in the standby portion, configured to convey the plurality of sheets kept on the standby portion to the first conveyance portion, wherein the control unit controls the first conveyance portion so that the sheet conveyed from the sheet conveyance portion is conveyed to the sheet stacking portion with normal rotation of the first conveyance portion and that the sheets are conveyed to the standby portion with reverse rotation thereof, and controls the second conveyance portion so that the sheets conveyed with reverse rotation of the first conveyance portion are conveyed into the standby portion with normal rotation of the second conveyance portion and that the sheets conveyed into the standby portion are conveyed to the first conveyance portion with reverse rotation of the second conveyance portion;

an end portion stopper against which one end in a sheet conveyance direction of each of the plurality of sheets conveyed from the overlapping portion to the sheet stacking portion is abutted;

a discharging portion configured to discharge the overlapped sheets overlapped by the overlapping portion toward the end portion stopper at a predetermined speed that ends of the overlapped sheets would abut against the end portion stopper by inertia; and a control unit configured to control the overlapping portion such that when the plurality of sheets are discharged onto the stacking portion, an end of a first sheet of the plurality of sheets being lowermost on the stacking portion, to be abutted against the end portion stopper, is closer to the end portion stopper than an end of a second sheet on the first sheet, to be abutted against the end portion stopper, and the end of the second sheet is closer to the end portion stopper than an end of a third sheet on the second sheet, to be abutted against the end portion stopper, and the end of the third sheet is closer to the end portion stopper than an end of a fourth sheet on the third sheet, to be abutted against the end portion stopper, a shift amount between the end of the first sheet and the end of the second sheet being larger than a shift amount between the end of the third sheet and the end of the fourth sheet thereby each end of the overlapped sheets discharged by the discharging portion toward the end portion stopper at the predetermined speed is abutted against the end portion stopper by inertia and the sheets do not rebound by the end portion stopper.

16. The sheet processing apparatus according to claim 15, further comprising a detection unit provided on an upstream in the sheet conveyance direction of a branching-off point of the sheet conveyance path and the standby portion and configured to detect a sheet, wherein the control unit controls, based on a signal from the detection unit, the second conveyance portion to make reverse rotation so as to convey the sheet on the standby portion to the first conveyance portion.

17. The sheet processing apparatus according to claim 16, wherein the control unit successively changes timing at which the reverse rotation of the second conveyance portion is started so as to successively change the shift amount.

18. The sheet processing apparatus according to claim 16, wherein the control unit successively changes a sheet conveyance speed at a time of the reverse rotation of the second conveyance portion so as to successively change the shift amount.

19. The sheet processing apparatus according to claim 16, wherein the control unit successively change an amount of conveying of the sheet into the standby portion with the normal rotation of the second conveyance portion so as to successively change the shift amount.

20. The sheet processing apparatus according to claim 15, the control unit controls the overlapping portion so that the end of the third sheet is closer to the end portion stopper than an end of a fourth sheet on the third sheet, to be abutted against the end portion stopper, the shift amount between the end of the second sheet and the end of the third sheet being larger than a shift amount between the end of the third sheet and the end of the fourth sheet.

21. The sheet processing apparatus according to claim 20, wherein the overlapping portion can convey at least five sheets in the overlapped state.

22. The sheet processing apparatus according to claim 15, wherein the control unit controls the overlapping portion such that when at least five sheets are discharged onto the stacking portion, the shift amount between the end of the first sheet and the end of the second sheet being larger than the shift amount between the end of the third sheet and the end of the fourth sheet and a shift amount between the end of the second sheet and the end of the third sheet being larger than the shift amount between the end of the third sheet and the end of the fourth sheet.

23. A sheet processing apparatus configured to process sheets comprising:

a sheet conveyance portion configured to convey a sheet;

a sheet stacking portion on which sheets, conveyed by the sheet conveyance portion, to be processed are stacked;

an overlapping portion, arranged between the sheet stacking portion and the sheet conveyance portion, configured to overlap a plurality of sheets to be discharged on the sheet stacking portion one on the other and keep the plurality of sheets on standby while preceding sheets on the sheet stacking portion are being processed, wherein the overlapping portion including, a standby portion branching off from a sheet conveyance path provided between the sheet stacking portion and the sheet conveyance portion and configured to keep on standby the plurality of sheets in the overlapped state, a first conveyance portion configured to convey from the standby portion the plurality of sheets that have been kept on standby at the standby portion, and a second conveyance portion, provided in the standby portion, configured to convey the plurality of sheets kept on the standby portion to the first conveyance portion, wherein the control unit controls the first conveyance portion so that the sheet conveyed from the sheet conveyance portion is conveyed to the sheet stacking portion with normal rotation of the first conveyance portion and that the sheets are conveyed to the standby portion with reverse rotation thereof, and controls the second conveyance portion so that the sheets conveyed with reverse rotation of the first conveyance portion are conveyed into the standby portion with normal rotation of the second conveyance portion and that the sheets conveyed into the standby portion are conveyed to the first conveyance portion with reverse rotation of the second conveyance portion;

an end portion stopper against which one end in a sheet conveyance direction of each of the plurality of sheets conveyed from the overlapping portion to the sheet stacking portion is abutted;

a discharging portion which discharges the overlapped sheets toward the end portion stopper at a predetermined speed that ends of the overlapped sheets would abut against the end portion stopper by inertia; and a control unit configured to control the overlapping portion so that, when N pieces of sheets, where N is a natural number larger than 4, overlapped by the overlapping portion is discharged to the sheet stacking portion, the lower a sheet is, the more the sheet is shifted toward the end portion stopper, and a shift amount between a first sheet that is a lowermost sheet of the N pieces of sheets on the sheet stacking portion and a second sheet on the first sheet to be larger than a shift amount between a N-2th sheet of the N pieces of sheets and a N-lth sheet of the N pieces of sheets on the N-2th sheet thereby at least each end of the first to N-1 th sheets discharged by the discharging portion toward the end portion stopper at the predetermined speed on the sheet stacking portion is abutted against the end portion stopper by inertia.

24. The sheet processing apparatus according to claim 23, wherein in a case that the overlapping portion overlaps five sheets, the control unit controls the overlapping portion so that when the five sheets overlapped by the overlapping portion is discharged to the sheet stacking portion, the shift amount between the first sheet and the second sheet is larger than a shift amount between a third sheet of the plurality of sheets and a fourth sheet of the plurality of sheets.

25. The sheet processing apparatus according to claim 24, wherein the control unit controls the overlapping portion so that when the five sheets overlapped by the overlapping portion is discharged to the sheet stacking portion, the shift amount between the second sheet and the third sheet is larger than a shift amount between the third second sheet and the fourth sheet.

26. The sheet processing apparatus according to claim 23, wherein the control unit controls the overlapping portion so that when the plurality of sheets overlapped by the overlapping portion is discharged to the sheet stacking portion, the shift amount between the first sheet and the second sheet is larger than a shift amount between a fourth sheet of the plurality of sheets and a fifth sheet of the plurality of sheets.

27. The sheet processing apparatus according to claim 23, wherein in a case that the overlapping portion overlaps five sheets, the control unit controls the overlapping portion so that when the five sheets overlapped by the overlapping portion is discharged to the sheet stacking portion, the shift amount between the first sheet and the second sheet is larger than a shift amount between the second sheet and a third sheet of the plurality of sheets.

28. The sheet processing apparatus according to claim 23, wherein the control unit controls the overlapping portion so that when the five sheets overlapped by the overlapping portion is discharged to the sheet stacking portion, the shift amount between the second sheet and a third sheet is larger than a shift amount between the third second sheet and a fourth sheet of the plurality of sheets.

29. The sheet processing apparatus according to claim 23, wherein in a case that the overlapping portion overlaps five sheets, the control unit controls the overlapping portion so that when the five sheets overlapped by the overlapping portion is discharged to the sheet stacking portion, the shift amount between the second sheet and the third second sheet is larger than a shift amount between a third sheet of the plurality of sheets and a fourth sheet of the plurality of sheets.

* * * * *